US007444803B2

(12) United States Patent
Iwamoto et al.

(10) Patent No.: US 7,444,803 B2
(45) Date of Patent: Nov. 4, 2008

(54) EXHAUST GAS CONTROL APPARATUS FOR ENGINE AND METHOD FOR PRODUCING SAME

(75) Inventors: Yasunori Iwamoto, Toyota (JP); Masaharu Kuroda, Toyota (JP); Yasuhiro Nobata, Toyota (JP); Toshio Murata, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/290,642

(22) Filed: Dec. 1, 2005

(65) Prior Publication Data

US 2006/0123772 A1 Jun. 15, 2006

(30) Foreign Application Priority Data

Dec. 15, 2004 (JP) ..... 2004-363563
May 9, 2005 (JP) ..... 2005-136147

(51) Int. Cl.
*F01N 3/00* (2006.01)

(52) U.S. Cl. ..... 60/288; 60/274; 60/287; 60/292; 60/295; 60/297; 60/299

(58) Field of Classification Search ..... 60/274, 60/285, 287, 288, 292, 295, 296, 300, 324, 60/299, 297
See application file for complete search history.

(56) References Cited

U.S. PATENT DOCUMENTS 5,517,820 A * 5/1996 Kuroda et al. ..... 60/274
5,771,684 A * 6/1998 Hertl et al. ..... 60/274
6,321,530 B1 * 11/2001 Hoshi et al. ..... 60/274
6,321,533 B1 * 11/2001 Watanabe et al. ..... 60/324
6,370,872 B1 * 4/2002 Watanabe et al. ..... 60/288
6,389,804 B1 * 5/2002 Yasui et al. ..... 60/277
6,397,586 B1 * 6/2002 Sakurai et al. ..... 60/288
6,401,451 B1 * 6/2002 Yasui et al. ..... 60/277
2004/0067177 A1 * 4/2004 Thieman et al. ..... 422/177

FOREIGN PATENT DOCUMENTS

JP A 5-59942 3/1993
JP A 2000-345829 12/2000
JP A 2001-115830 4/2001

* cited by examiner

*Primary Examiner*—Binh Q Tran
(74) *Attorney, Agent, or Firm*—Oliff & Berridge, PLC

(57) ABSTRACT

An exhaust gas control apparatus for an engine and a method for producing the same are provided. The exhaust gas control apparatus includes a valve portion, an absorption portion, and a catalyst portion. The valve portion includes a valve that opens/closes a main exhaust passage. The absorption portion includes a hydrocarbon-absorbent that absorbs hydrocarbons. The catalyst portion includes a three-way catalyst that purifies exhaust gas. The valve portion, absorption portion, and the catalyst portion are independent of each other. The valve portion, the absorption portion, and the catalyst portion are connected to each other in series. With this configuration, any individual component can be replaced with another corresponding component that achieves a required level of performance while minimizing the number of other components.

36 Claims, 16 Drawing Sheets

CROSS SECTIONAL VIEW WHEN VALVE 44 IS CLOSED

CROSS SECTIONAL VIEW WHEN VALVE 44 IS CLOSED

CROSS SECTIONAL VIEW WHEN VALVE 44 IS OPEN

EXHAUST GAS CONTROL APPARATUS FOR ENGINE AND METHOD FOR PRODUCING SAME

INCORPORATION BY REFERENCE

The disclosure of Japanese Patent Application No. 2004-363563 filed on Dec. 15, 2004 and No. 2005-136147 filed on May 9, 2005, including the specification, drawings and abstract is incorporated herein by reference in its entirety.

FIELD OF THE INVENTION

The invention relates to an exhaust gas control apparatus for an engine, which includes a hydrocarbon-absorbent that absorbs hydrocarbons present in exhaust gas.

DESCRIPTION OF THE RELATED ART

Exhaust gas control apparatuses for an engine remove nitrogen oxide, carbon monoxide, and hydrocarbons using a three-way catalyst. However, when the temperature of the three-way catalyst is low, the exhaust gas control apparatuses unable to remove hydrocarbons efficiently.

Japanese Patent Application Publication No. JP-A-2000-345829 (hereinafter, referred to as "No. 2000-345829") discloses an exhaust gas control apparatus including a hydrocarbon-absorbent that temporarily captures hydrocarbons.

In the exhaust gas control apparatus including a hydrocarbon-absorbent disclosed in No. 2000-345829, the hydrocarbon-absorbent absorbs hydrocarbons when the temperature of a three-way catalyst is low, and releases the hydrocarbons to the three-way catalyst when the three-way catalyst can remove hydrocarbons. With this configuration, hydrocarbons present in exhaust gas can be appropriately removed.

In the exhaust gas control apparatus described in No. 2000-345829, when the three-way catalyst is replaced with another one having a larger cross sectional area, which improves the performance of exhaust gas purification and reduces back pressure, the associated components in the exhaust gas control apparatus (i.e., a casing, a pipe, and the hydrocarbon-absorbent) also need to be replaced with corresponding components in accordance with the size of the three-way catalyst.

SUMMARY OF THE INVENTION

In view of the above, it is an object of the invention to provide an exhaust gas control apparatus for an engine, where the components can be individually replaced with another one based on the required level of performance while minimizing the number of other components to be replaced, and a method for producing the same.

According to an aspect of the invention, an exhaust gas control apparatus for an engine includes an absorption portion, a valve portion, and a catalyst portion. The absorption portion includes a first exhaust passage and a second exhaust passage, and a hydrocarbon-absorbent. The first exhaust passage and the second exhaust passage have respective openings located at different positions. The openings allow exhaust gas discharged from an engine to flow into the absorption portion. The hydrocarbon-absorbent is provided within the first exhaust passage, and absorbs hydrocarbons present in the exhaust gas. The valve portion includes a valve that opens/closes the second exhaust passage. The valve portion changes the mode where the exhaust gas flows by opening/closing the second exhaust passage using the valve. The catalyst portion includes a catalyst that purifies the exhaust gas. The absorption portion, the valve portion, and the catalyst portion are independent of each other. The absorption portion, the valve portion, and the catalyst portion are connected to each other in series.

In the exhaust gas control apparatus having the above configuration, each of the absorption portion, the valve portion, and the catalyst portion can each be replaced independently of the other portions with another corresponding portion to achieve the required level of performance. Therefore, for example, the size of the catalyst can be changed without replacing the hydrocarbon-absorbent. With this configuration, any individual component may be replaced with another corresponding component to achieve the required level of performance while minimizing the number of other components to be replaced.

According to another aspect of the invention, an exhaust gas control apparatus includes a first structure, a second structure, and a third structure. The first structure includes a hydrocarbon-absorbent that absorbs hydrocarbons present in exhaust gas discharged from an engine. The second structure includes a catalyst that purifies the exhaust gas discharged from the engine. The third structure changes the mode where the exhaust gas flows between two modes. In one mode, all of the exhaust gas passes through the hydrocarbon-absorbent. In another mode, part of the exhaust gas does not pass through the hydrocarbon-absorbent. The first structure, the second structure, and the third structure are independent of each other. The first structure, the second structure, and the third structure are disposed in series, and are joined to each other.

In the exhaust gas control apparatus for an engine having the aforementioned configuration, each of the first structure, the second structure, and the third structure can be replaced independently of the other portions with another corresponding structure to achieve the required level of performance. Therefore, for example, the size of the catalyst can be changed without replacing the hydrocarbon- absorbent. With this configuration, any individual structure may be replaced with another corresponding structure to achieve the required level of performance while minimizing the number of other components to be replaced.

According to another aspect of the invention, an exhaust gas control apparatus includes a first structure, and a second structure. The first structure includes a hydrocarbon-absorbent that absorbs hydrocarbons present in exhaust gas discharged from an engine. The second structure includes a catalyst that purifies the exhaust gas discharged from the engine. The first structure and the second structure are independent of each other. The first structure and the second structure are disposed in series, and are joined to each other.

In the exhaust gas control apparatus for an engine having the aforementioned configuration, each of the first structure and the second structure may be replaced independently of the other structure with another corresponding structure to achieve the required level of performance. Therefore, for example, the size of the catalyst can be changed without replacing the hydrocarbon-absorbent. With this configuration, any individual component may be replaced with another corresponding component to achieve the required level of performance while minimizing the number of other components to be replaced.

According to another aspect of the invention, a method for producing an exhaust gas control apparatus for an engine, which includes a catalyst that purifies exhaust gas discharged from an engine, and a hydrocarbon-absorbent that absorbs hydrocarbons present in the exhaust gas. The method includes a first step of selecting an absorption portion that achieves the required level of performance; a second step of selecting a valve portion that achieves the required level of performance; a third step of selecting a catalyst portion that achieves the required level of performance; and a fourth step of disposing the selected absorption portion, the valve portion, and the catalyst portion in series, and joining them to each other. Each valve portion includes a first exhaust passage and a second exhaust passage, and a hydrocarbon-absorbent. The first exhaust passage and the second exhaust passage include respective openings located at different positions, and the openings allow the exhaust gas to flow into the absorption portion. The hydrocarbon-absorbent is provided in the first exhaust passage, and absorbs hydrocarbons present in the exhaust gas. Each valve portion includes a valve that opens/closes the second exhaust passage. Each valve portion changes the mode where the exhaust gas flows by opening/closing the second exhaust passage using the valve. Each catalyst portion includes the catalyst.

In the exhaust gas control apparatus having the aforementioned configuration and the method for producing the same, the exhaust gas control apparatus is formed by selecting the absorption portion, the valve portion, and the catalyst portion that achieve the respective required levels of performance, and joining them to each other. Therefore, when producing different types of exhaust gas control apparatuses, any individual component may be replaced with another corresponding component that achieves the required level of performance while minimizing the number of other components to be replaced.

BRIEF DESCRIPTION OF THE DRAWINGS

The features, advantages thereof, and technical industrial significance of this invention will be better understood by reading the following detailed description of the example embodiments of the invention, when considered in connection with the accompanying drawings, in which.

DETAILED DESCRIPTION OF THE EXEMPLE EMBODIMENTS

In the following description and the accompanying drawings, the present invention will be described in more detail with reference to example embodiments. An example embodiment of the invention will be described with reference to FIG. 1 through FIG. 20. In this embodiment, the phrase "exhaust gas flows from the upstream side to the downstream side" signifies that exhaust gas flows from the engine toward the atmosphere.

Figure 1:
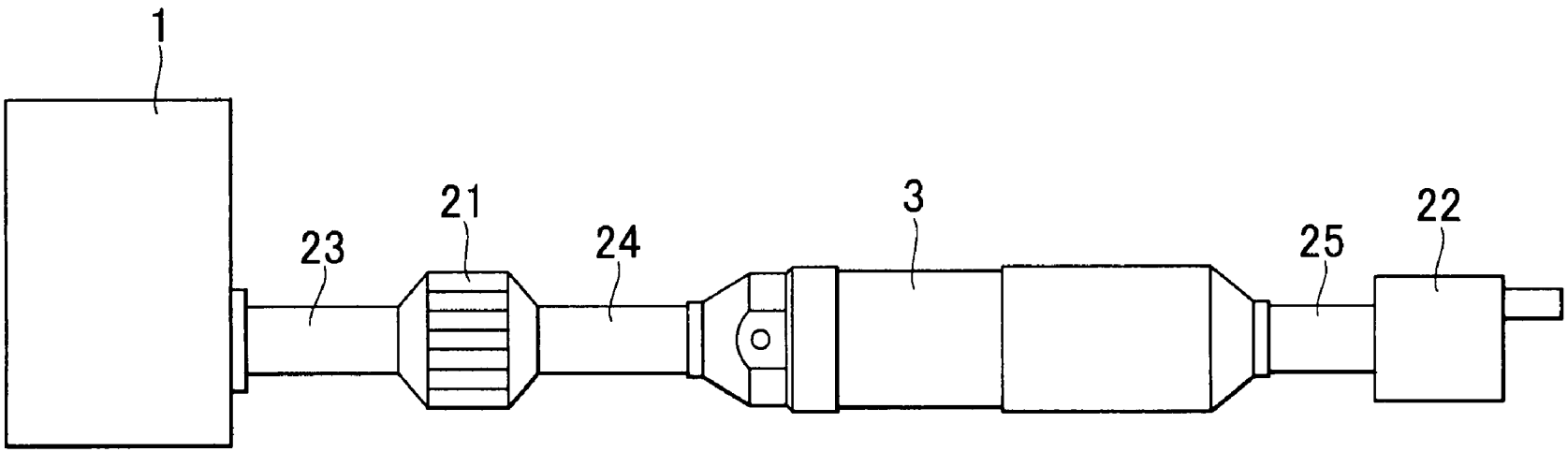
FIG. 1 illustrates the entire configuration of an exhaust system to which an exhaust gas control apparatus for an engine according to an embodiment of the invention is applied.

FIG. 1 illustrates the structure of an engine exhaust system. The exhaust system for an engine 1 includes a catalytic-converter 21, a catalytic-converter 3 with an absorbent, and a muffler 22.

The engine 1 is connected to the catalytic-converter 21 via a first exhaust pipe 23. The catalytic-converter 21 is connected to the catalytic-converter 3 via a second exhaust pipe 24.

Figure 2:
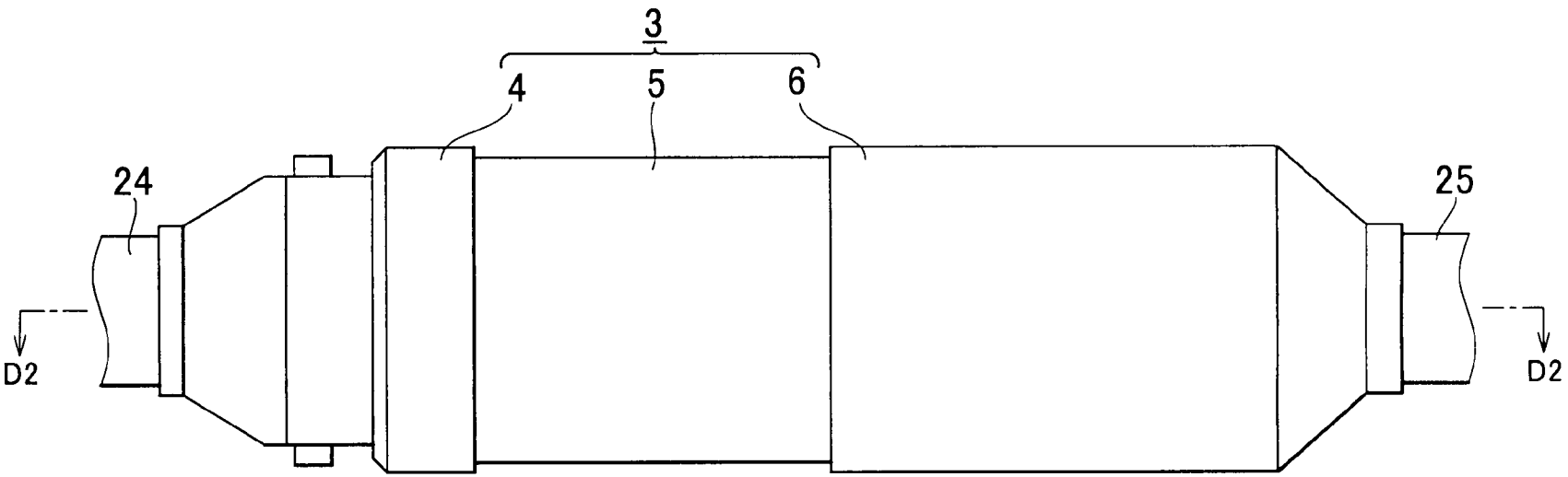
FIG. 2 illustrates the plane view of a catalytic-converter with an absorbent in the exhaust gas control apparatus for an engine according to the embodiment.

The catalytic-converter 3 is connected to the muffler 22 via a third exhaust pipe 25. FIG. 2 illustrates the entire structure of the catalytic-converter 3.

The catalytic-converter 3 includes a valve portion 4 (third structure), an absorption portion 5 (first structure), and a catalyst portion 6 (second structure). The valve portion changes the mode where the exhaust gas flows in the catalytic-converter 3. The absorption portion 5 includes an absorbent that absorbs hydrocarbon in exhaust gas. The catalyst portion 6 includes a catalyst that purifies exhaust gas.

In the catalytic-converter 3, the valve portion 4, the absorption portion 5, and the catalyst portion 6 are arranged in the stated order from the upstream side to the downstream side. These portions are independent of each other.

In the catalytic-converter 3, the valve portion 4 is connected to the upstream-side of the absorption portion 5, and the catalyst portion 6 is connected to the downstream-side of the absorption portion 5. The second exhaust pipe 24 is connected to the upstream-side of the valve portion 4. The third exhaust pipe 25 is connected to the downstream-side of the catalyst portion 6. Hereinafter, the structure of each portion will be described.

Figure 3:
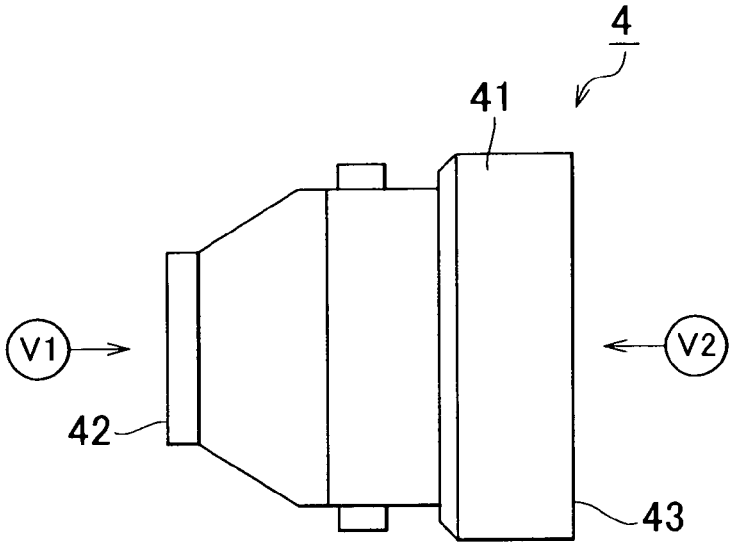
FIG. 3 illustrates the plane view of a valve portion in the exhaust gas control apparatus for an engine according to the embodiment.
Figure 4:
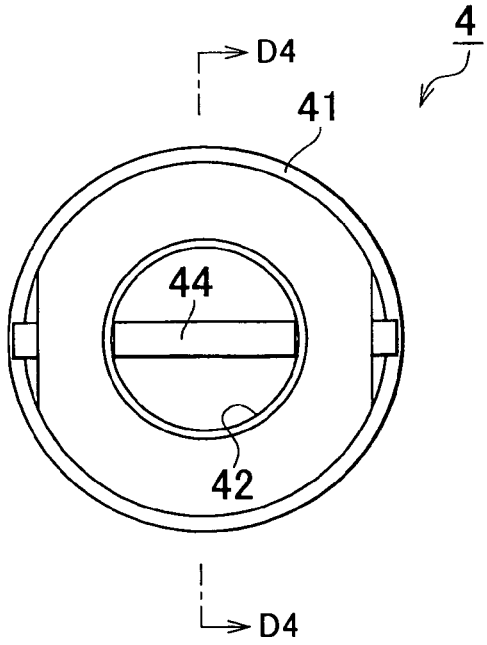
FIG. 4 illustrates the front view from the perspective indicated by an arrow V1 in FIG. 3, of the valve portion in the exhaust gas control apparatus for an engine according to the embodiment.

[1] The structure of the valve portion will be described. FIG. 3 illustrates the plane view of the valve portion 4. FIG. 4 illustrates the front view of the valve portion 4 from the perspective indicated by an arrow V1 in FIG. 3.

Figure 5:
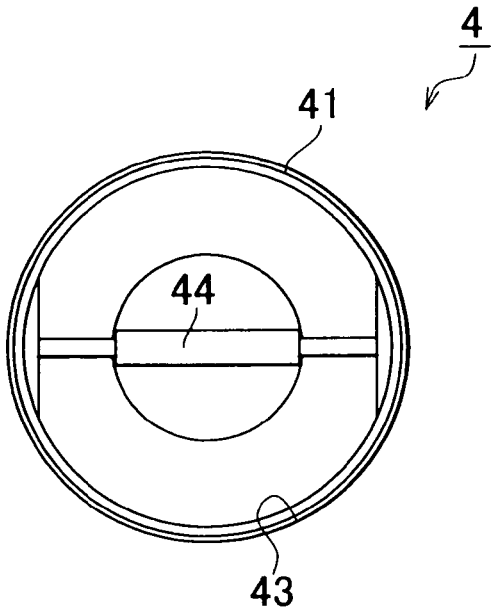
FIG. 5 illustrates the front view from the perspective indicated by an arrow V2 in FIG. 3, of the valve portion in the exhaust gas control apparatus for an engine according to the embodiment.
Figure 6:
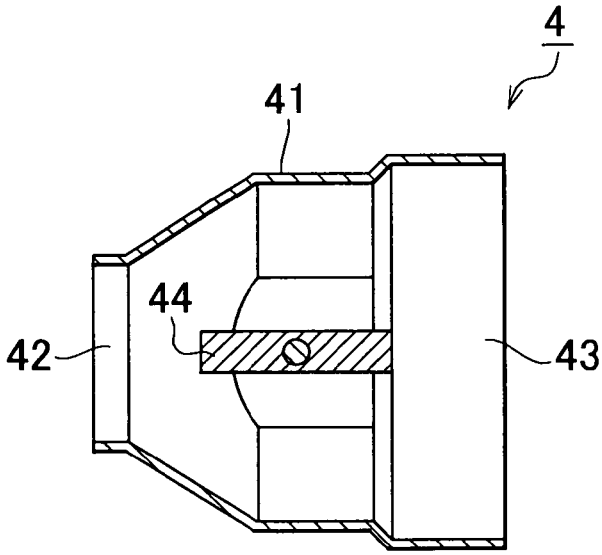
FIG. 6 illustrates the cross sectional view taken along line D4-D4 in FIG. 4, of the valve portion in the exhaust gas control apparatus for an engine according to the embodiment.

FIG. 5 illustrates the front view of the valve portion 4 from the perspective indicated by an arrow V2 in FIG. 3. FIG. 6 illustrates the cross sectional view of the valve portion 4 taken along line D4-D4 in FIG. 3. The valve portion 4 includes an external cylinder 41 that is the main body of the valve portion 4.

The external cylinder 41 encloses the valve portion 4. The external cylinder 41 includes an opening 42 positioned at the upstream side thereof, and an opening 43 positioned at the downstream side thereof.

The opening 42 allows exhaust gas to flow between the space upstream of the valve portion 4 and the space inside the valve portion 4. The second exhaust pipe 24 is inserted in the opening 42. That is, the inner diameter of the opening 42 is substantially equal to the outer diameter of the second exhaust pipe 24.

Exhaust gas flows between the space inside the valve portion 4 and the space downstream of the valve portion 4 through opening 43. The absorption portion 5 is inserted in the opening 43 (i.e., the external cylinder 51 of the absorption portion 5 is inserted in the opening 43). That is, the inner diameter of the opening 43 is substantially equal to the outer diameter of external cylinder 51 of the absorption portion 5.

A valve 44 changes the mode where the exhaust gas flows in the catalytic-converter 3 and is provided inside the external cylinder 41 of the valve portion 4. The valve 44 is controlled to be opened/closed by an electronic control unit that controls the engine 1.

Figure 7:
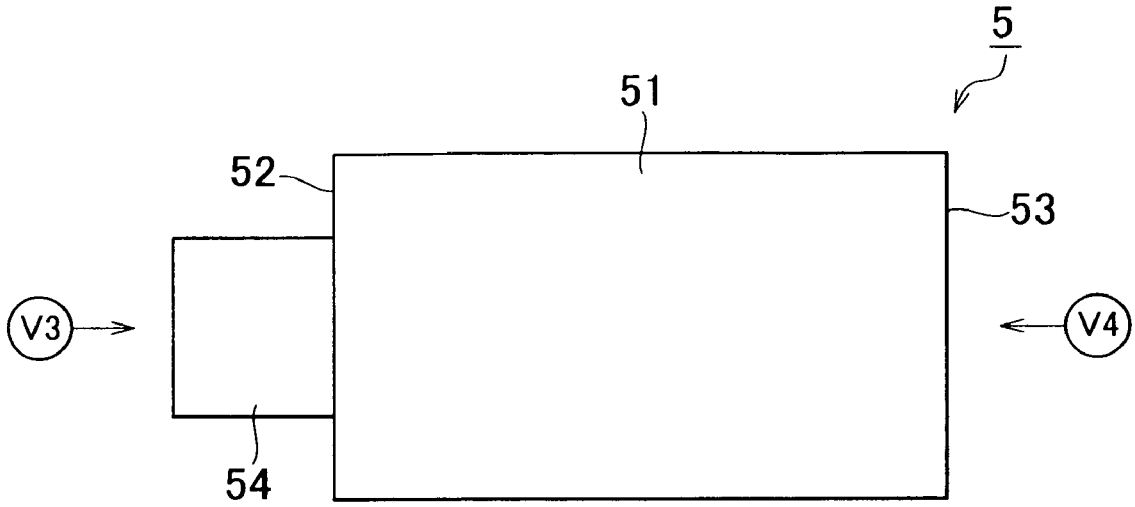
FIG. 7 illustrates the plane view of an absorption portion in the exhaust gas control apparatus for an engine according to the embodiment.
Figure 8:
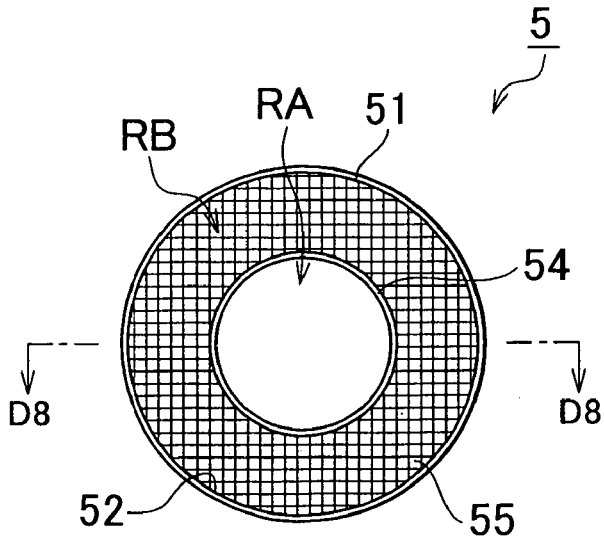
FIG. 8 illustrates the front view from the perspective indicated by an arrow V3 in FIG. 7, of the absorption portion in the exhaust gas control apparatus for an engine according to the embodiment.

Next, the structure of the absorption portion will be described. FIG. 7 illustrates the plane view of the absorption portion 5. FIG. 8 illustrates the front view of the absorption portion 5 from the perspective indicated by an arrow V3 in FIG. 7.

Figure 9:
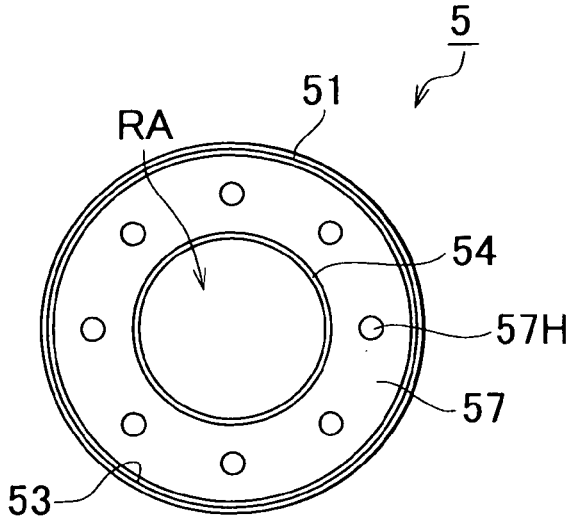
FIG. 9 illustrates the front view from the perspective indicated by an arrow V4 in FIG. 7, of the absorption portion in the exhaust gas control apparatus for an engine according to the embodiment.
Figure 10:
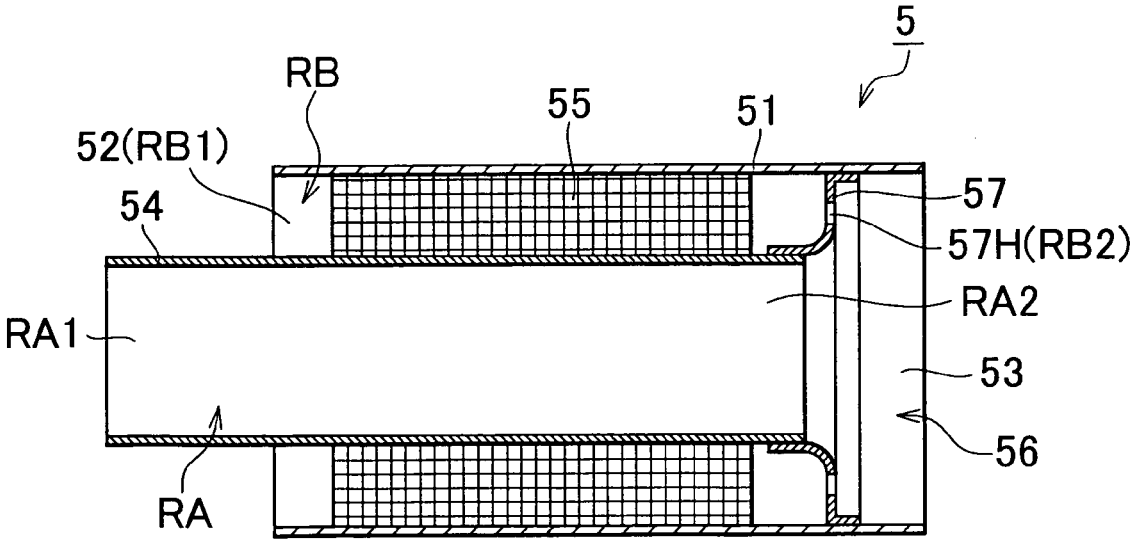
FIG. 10 illustrates the cross sectional view taken along line D8-D8 in FIG. 8, of the absorption portion in the exhaust gas control apparatus for an engine according to the embodiment.

FIG. 9 illustrates the front view of the absorption portion 5 from the perspective indicated by an arrow V4 in FIG. 7. FIG. 10 illustrates the cross sectional view of the absorption portion 5 taken along line D8-D8 in FIG. 8. The absorption portion 5 includes an external cylinder 51 that is the main body of the absorption portion 5.

The external cylinder 51 encloses the absorption portion 5. The external cylinder 51 includes an opening 52 positioned at the upstream side thereof and an opening 53 positioned at the downstream side thereof.

Exhaust gas flows between the space upstream of the absorption portion 5 and the space inside the absorption portion 5 through opening 52. The opening 52 is inserted in the valve portion 4. Exhaust gas flows between the space inside the absorption portion 5 and the space downstream of the absorption portion 5 through opening 53. The opening 53 is inserted in the catalyst portion 6 (i.e., the opening 53 is inserted in an external cylinder 61 of the catalyst portion 6). That is, the outer diameter of the opening 53 is substantially equal to the inner diameter of the external cylinder 61 of the catalyst portion 6.

An internal cylinder 54 of the absorption portion 5 is provided within the external cylinder 51 of the absorption portion 5. A main exhaust passage RA, which extends along the axis of the absorption portion 5, is formed inside the internal cylinder 54. The main exhaust passage RA corresponds to the second exhaust passage according to the invention.

The internal cylinder 54 of the absorption portion 5 includes an opening RA1 positioned at the upstream side thereof and an opening RA2 positioned at the downstream side thereof. The opening RA1 allows exhaust gas to flow between the space upstream of the internal cylinder 54 and the main exhaust passage RA.

Exhaust gas flows between the main exhaust passage RA and the space downstream of the internal cylinder 54 through opening RA2. The internal cylinder 54 is fixed to the external cylinder 51 such that an end portion of the internal cylinder 54 at the upstream side thereof protrudes from the external cylinder 51.

An outer exhaust passage RB is formed between the inner surface of the external cylinder 51 and the outer surface of the internal cylinder 54. The outer exhaust passage RB extends along the axis of the absorption portion 5.

The opening 52 functions as the opening of the outer exhaust passage RB at the upstream side thereof. Therefore, the opening 52 may also be referred to as "opening RB1". The opening 52 allows exhaust gas to flow between the space upstream of external cylinder 51 and the outer exhaust passage RB.

The outer exhaust passage RB is provided with a hydrocarbon-absorbent 55 that temporarily captures hydrocarbon present in exhaust gas. A partition 57 is provided downstream of the hydrocarbon-absorbent 55. The partition 57 separates the outer exhaust passage RB from the space that is positioned downstream of the main exhaust passage RA and the outer exhaust passage RB inside the absorption portion 5 (i.e., a space 56 at the downstream side of the absorption portion 5).

One end of the partition 57 is joined to the inner surface of the external cylinder 51. The other end of the partition 57 is joined to the outer surface of the internal cylinder 54. The partition 57 is provided with a plurality of holes (partition holes 57H) through which exhaust gas flows between the outer exhaust passage RB and the space 56 inside the absorption portion 5. That is, the partition holes 57H function as the downstream-openings of the outer exhaust passage RB. Therefore, the partition holes 57H may also be referred to as "openings RB2". The openings RB2 correspond to the downstream-opening according to the invention.

Figure 11:
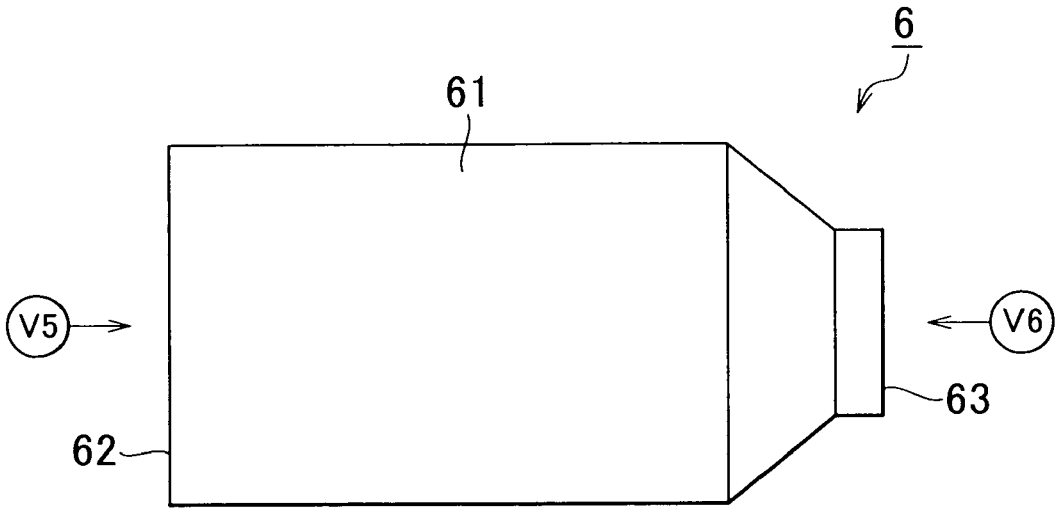
FIG. 11 illustrates the plane view of a catalyst portion in the exhaust gas control apparatus for an engine according to the embodiment.
Figure 12:
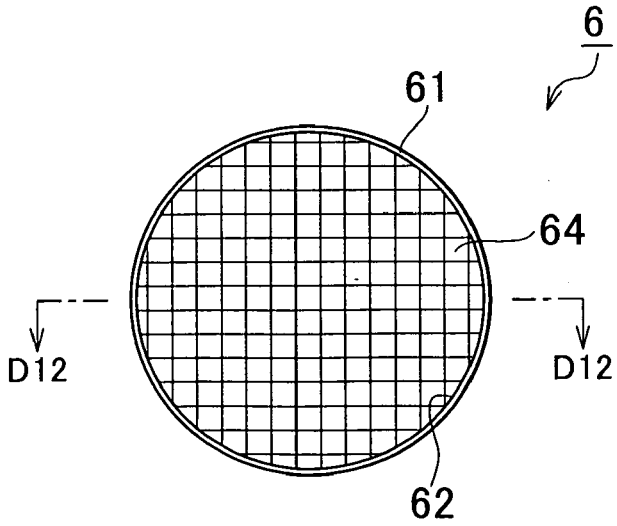
FIG. 12 illustrates the front view from the perspective indicated by an arrow V5 in FIG. 11, of the catalyst portion in the exhaust gas control apparatus for an engine according to the embodiment.

[3] Next, the structure of the catalyst portion will be described. FIG. 11 illustrates the front view of the catalyst portion 6. FIG. 12 illustrates the front view of the catalyst portion 6 from the perspective indicated by an arrow V5 in FIG. 11.

Figure 13:
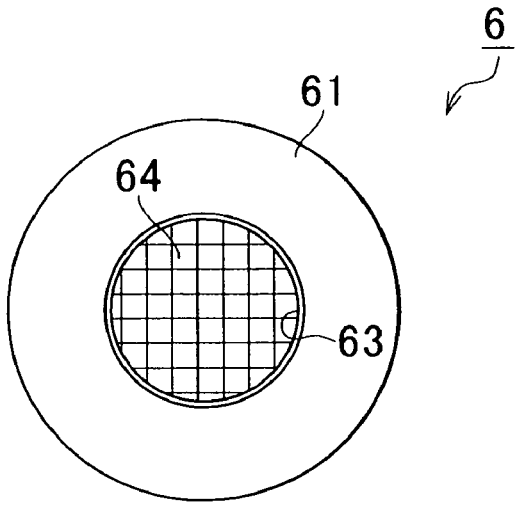
FIG. 13 illustrates the front structure from the perspective indicated by an arrow V6 in FIG. 11, of the catalyst portion in the exhaust gas control apparatus for an engine according to the embodiment.
Figure 14:
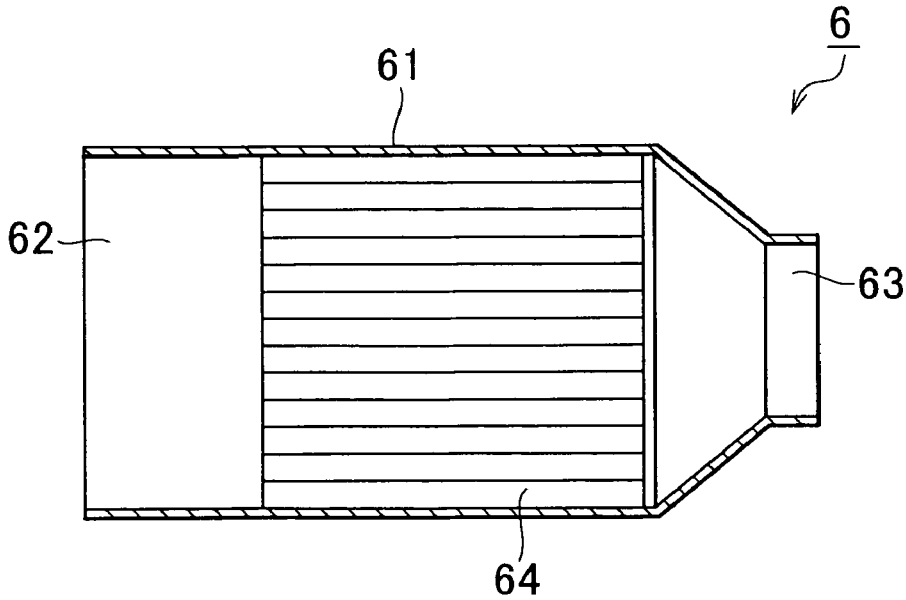
FIG. 14 illustrates the cross sectional view taken along line D12-D12 in FIG. 12, of the exhaust gas control apparatus according to the embodiment.

FIG. 13 illustrates the front view of the catalyst portion 6 from the perspective indicated by an arrow V6 in FIG. 11. FIG. 14 illustrates the cross sectional view of the catalyst portion 6 taken along line D12-D12 in FIG. 12. The catalyst portion 6 includes an external cylinder 61 that is the main body of the catalyst portion 6.

The external cylinder 61 encloses the catalyst portion 6. The external cylinder 61 includes an opening 62 positioned at the upstream side thereof and an opening 63 at the downstream side thereof.

The opening 62 allows exhaust gas to flow between the space upstream of the catalyst portion 6 and the space inside the catalyst portion 6. The external cylinder 51 of the absorption portion 5 is inserted in the opening 62. Exhaust gas flows between the space inside the catalyst portion 6 and the space downstream of the catalyst portion 6 through opening 63. The third exhaust pipe 25 is inserted in the opening 63. The inner diameter of the opening 63 is substantially equal to the outer diameter of the third exhaust pipe 25.

A three-way catalyst 64 is provided inside the external cylinder 61 of the catalyst portion 6. The three-way catalyst 64 is disposed so that all of the exhaust gas flowing into the catalyst portion 6 passes through the three-way catalyst 64. The structure inside the catalyst converter 3 with the absorbent will be described with reference to FIG. 15 and FIG. 16.

Figure 15:
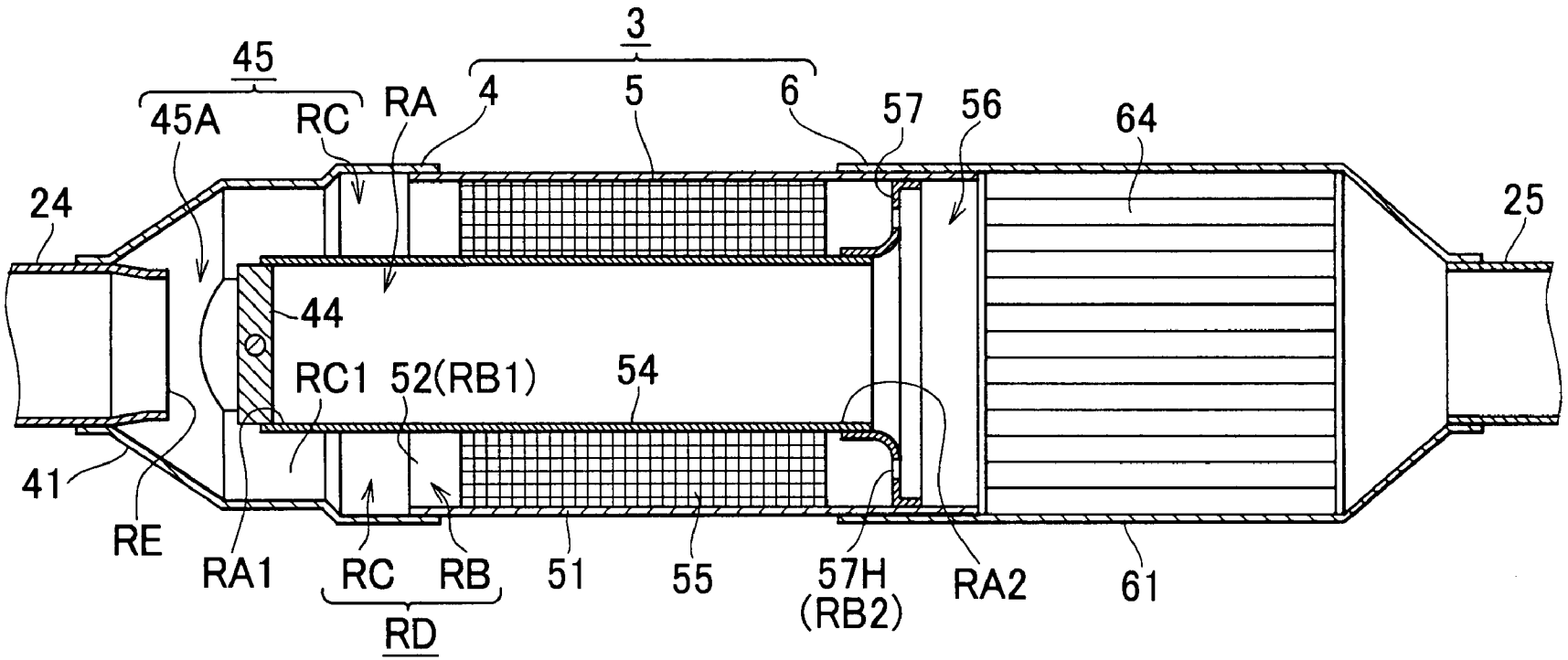
FIG. 15 illustrates the cross sectional view taken along line D2-D2 in FIG. 2, of a catalytic-converter with an absorbent in the exhaust gas control apparatus for an engine according to the embodiment.
Figure 16:
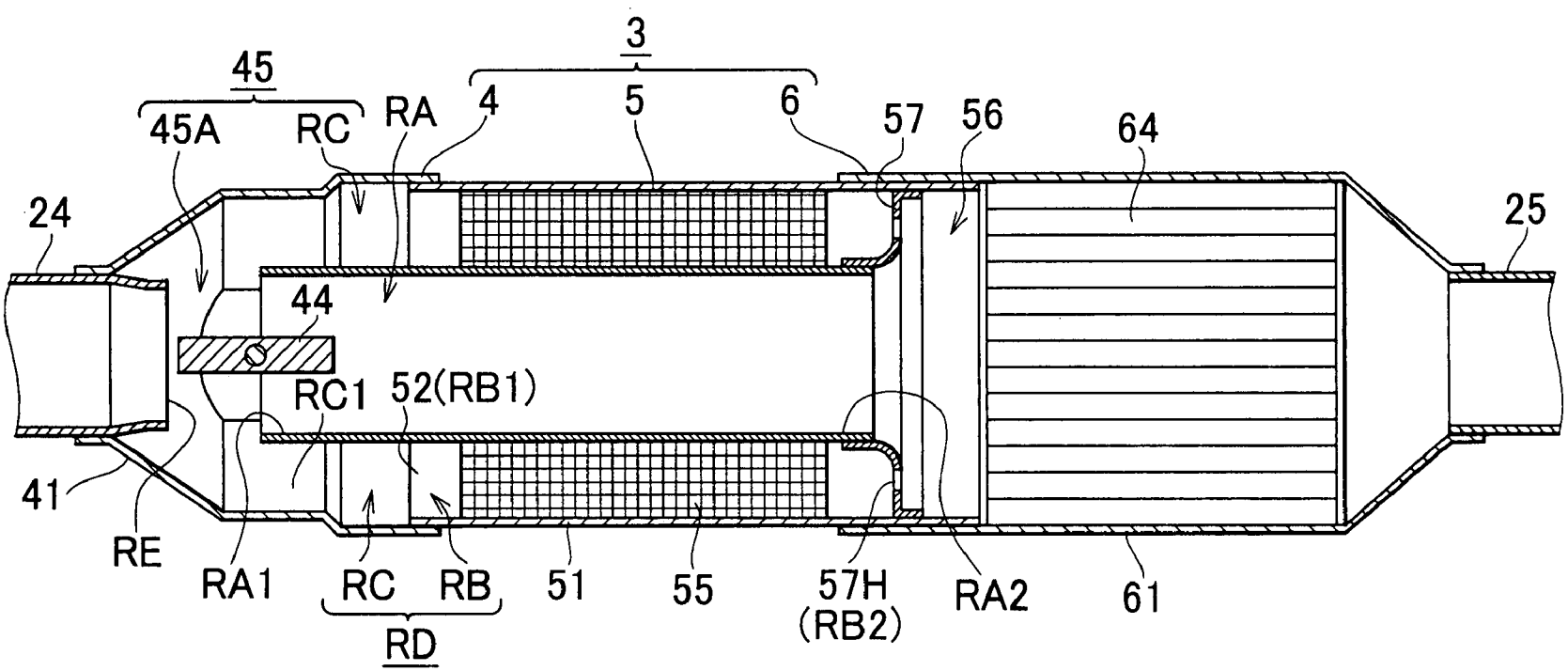
FIG. 16 illustrates the cross sectional view taken along line D2-D2 in FIG. 2, of the catalytic-converter with the absorbent in the exhaust gas control apparatus for an engine according to the embodiment.

FIG. 15 illustrates the cross sectional view taken along line D2-D2 in FIG. 2, of the catalyst converter 3 with the absorbent when the valve 44 is closed. FIG. 16 illustrates the cross sectional structure taken along line D2-D2 in FIG. 2, of the catalytic-converter 3 when the valve 44 is open.

In the catalytic-converter 3, the external cylinder 41 of the valve portion 4 is joined to the external cylinder 51 of the absorption portion 5, and the external cylinder 51 of the absorption portion 5 is joined to the external cylinder 61 of the catalyst portion 6. The second exhaust pipe 24 inserted in the opening 42 is joined to the external cylinder 41 of the valve portion 4.

The third exhaust pipe 25 inserted in the opening 63 is joined to the external cylinder 61 of the catalyst portion 6. The portion of the internal cylinder 54, which protrudes from the external cylinder 51, is positioned in the space inside the valve portion 4. The valve 44 is inserted in the opening RA1. Thus, the main exhaust passage RA can be opened/closed using the valve 44.

The space 45 inside the valve portion 4 includes a space 45A upstream of the opening RA1, and a space between the inner surface of the external cylinder 41 and the outer surface of the internal cylinder 54 (i.e., auxiliary-exhaust passage RC). The space 45A corresponds to the space upstream of the valve according to the invention.

The auxiliary-exhaust passage RC extends along the axis of the valve portion 4. The opening RB1 allows exhaust gas to flow between the auxiliary-exhaust passage RC and the outer exhaust passage RB.

Exhaust gas flows between the auxiliary-exhaust passage RC and the space 45A inside the valve portion 4 through an opening RC1 positioned at the upstream side of the auxiliary-exhaust passage RC. The opening RC1 corresponds to the upstream-opening according to the invention.

In the catalytic-converter 3, the auxiliary-exhaust passage RC and the outer exhaust passage RB constitute a sub-exhaust passage RD. The opening RC1 allows exhaust gas to flow between the space 45A inside the valve portion 4 and the sub-exhaust passage RD. That is, the opening RC1 functions as the upstream-opening of the sub-exhaust passage RD. Also, the openings RB2 allow exhaust gas to flow between the sub-exhaust passage RD and the space 56 inside the absorption portion 5. That is, the openings RB2 function as the openings of the sub-exhaust passage RD at the downstream side thereof.

The sub-exhaust passage RD is parallel with the main exhaust passage RA. Exhaust gas flowing through the main exhaust passage RA does not pass through the hydrocarbon-absorbent 55. The catalytic-converter 3 includes the valve portion 4, the absorption portion 5, and the catalyst portion 6. With this configuration, the mode where the exhaust gas flows can be changed as required. Hereinafter, the modes where the exhaust gas flows, and the configuration for allowing exhaust gas to flow in each mode will be described.

[1] First, the direction of flow of exhaust gas in the sub-exhaust passage (when the valve is open) will be described. When hydrocarbons released from the hydrocarbon-absorbent 55 are not sufficiently mixed with exhaust gas passing through the three-way catalyst 64, the concentration of hydrocarbons may become excessively high in the three-way catalyst 64. As a result, the three-way catalyst 64 cannot sufficiently remove hydrocarbons, and exhaust gas containing hydrocarbons is discharged to the atmosphere.

In the catalytic-converter 3 according to this embodiment, when the valve 44 is open, there is a reverse flow of exhaust gas in the sub-exhaust passage RD from the downstream side to the upstream side that flows into the space upstream of the valve 44. As such, hydrocarbons released from the hydrocarbon-absorbent 55 are sufficiently mixed with exhaust gas flowing through the main exhaust passage RA before the hydrocarbons reach the three-way catalyst 64. This improves the efficiency of the three-way catalyst 64 in removing hydrocarbons.

To allow exhaust gas to flow in the aforementioned mode, the catalytic-converter 3 has the configuration described in the following sections (a) through (e).

(a) The opening RC1 and the openings RB2 are positioned so that the pressure upstream of the opening RC1 is lower than the pressure downstream of the openings RB2 when the valve 44 is open. More specifically, the opening RC1 and the openings RB2 are positioned in the manner described in the following (b) and (c).

(b) The opening RC1 is positioned so as to allow exhaust gas to flow between the sub-exhaust passage RD and a space upstream of the sub-exhaust passage RD, where the exhaust gas does not swirl or stagnate when the valve 44 is open. The openings RB2 are positioned so as to allow exhaust gas to flow between the sub-exhaust passage RD and a space downstream of the sub-exhaust passage RD, where the exhaust gas swirls or stagnates when the valve 44 is open.

The pressure in the area where exhaust gas either swirls or stagnates is higher than the pressure in the area where exhaust gas does not swirl or stagnate. Therefore, in the aforementioned configuration, exhaust gas stably flows in the sub-exhaust passage RD from the downstream side to the upstream side when the valve 44 is open.

(c) The opening RC1 is positioned near the valve 44. The openings RB2 are positioned near the three-way catalyst 64.

In the catalyst converter 3 with the absorbent, the three-way catalyst 64 restricts the flow of exhaust gas, which makes the pressure upstream of the three-way catalyst 64 higher than the pressure near the valve 44. That is, by reducing the flow speed of the exhaust gas the three-way catalyst 64 increases backpressure in the exhaust system. Therefore, with this configuration, exhaust gas stably flows in the sub-exhaust passage RD from the downstream side to the upstream side when the valve 44 is open.

(d) An inlet port RE, through which exhaust gas in the second exhaust pipe 24 flows into the catalytic-converter 3, is disposed immediately upstream of the valve 44. In this embodiment, the downstream-opening of the second exhaust pipe 24 functions as the inlet port RE, and this opening is disposed immediately upstream of the valve 44.

As the distance between the inlet port RE and the valve 44 decreases, the flow amount of exhaust gas flowing into the main exhaust passage RA through the inlet port RE increases when the valve 44 is open. That is, as the distance between the inlet port RE and the valve 44 decreases, less exhaust gas flows into the sub-exhaust passage RD through the inlet port RE. Thus, with this configuration, the flow of the exhaust gas from the upstream side to the downstream side is unlikely to interfere with the flow of the exhaust gas from the downstream side to the upstream side in the sub-exhaust passage RD. Therefore, exhaust gas stably flows in the sub-exhaust passage RD from the downstream side to the upstream side.

Figure 17:
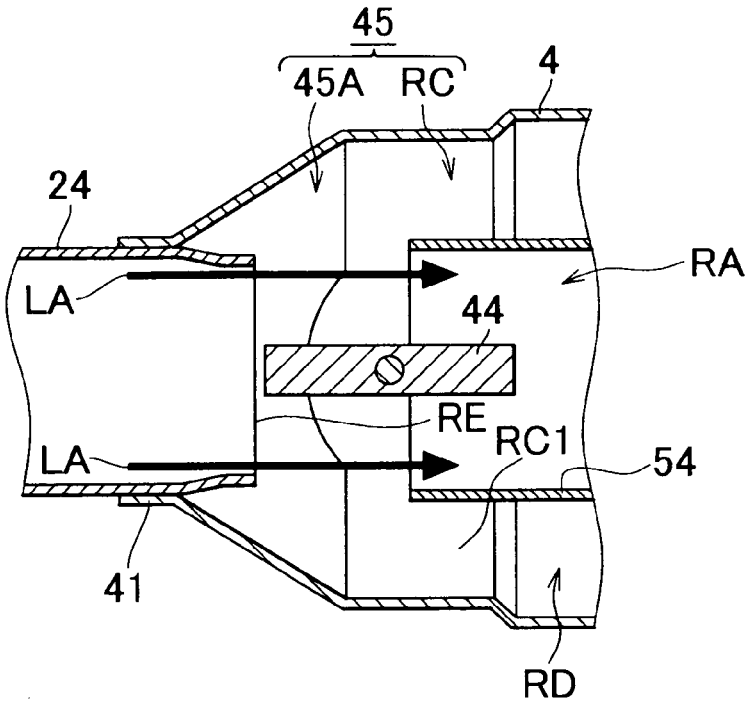
FIG. 17 illustrates the enlarged view of the structure near a partition in the exhaust gas control apparatus for an engine according to the embodiment.

(e) As shown in FIG. 17, the inlet port RE is positioned so that a straight flow of the exhaust gas from the inlet port RE (i.e., the flow indicated by a straight line LA) does not pass through the opening RC1. In this embodiment, the diameter of the inlet port RE is less than the outer diameter of the internal cylinder 54 of the absorption portion 5. Also, the axis of the second exhaust pipe 24 is substantially the same as the axis of internal cylinder 54 of the absorption portion 5.

However, if the opening RC1 is disposed such that the straight flow of the exhaust gas from the inlet port RE passes through the opening RC1 and enters the sub-exhaust passage RD, the straight flow of the exhaust gas would collide with the reverse flow of the exhaust gas in the sub-exhaust passage RD. This would interfere with the flow of the exhaust gas from the downstream side to the upstream side in the sub-exhaust passage RD.

In the configuration in this embodiment, the inlet port RE is positioned so as to avoid the aforementioned situation. Therefore, exhaust gas stably flows in the sub-exhaust passage RD from the downstream side to the upstream side.

[2] Next, the variation in the flow speed of the exhaust gas flowing in the sub-exhaust passage (when the valve is open) will be described. When the valve 44 is open, the flow speed of the exhaust gas flowing in the sub-exhaust passage RD varies mainly depending on the pressure downstream of the opening RB2. Meanwhile, the amount of hydrocarbons released from the hydrocarbon-absorbent 55 varies depending on the flow speed of the exhaust gas. Therefore, when the flow speed of the exhaust gas flowing in the sub-exhaust passage RD varies greatly, the hydrocarbon content of the exhaust gas flowing in the main exhaust passage RA will also vary greatly. As a result, the exhaust gas containing an excessively high concentration of hydrocarbons may flow into the three-way catalyst 64. This reduces the efficiency of the three-way catalyst 64 in removing hydrocarbons.

Accordingly, the catalytic-converter 3 in this embodiment is configured so that the flow speed of the exhaust gas flowing in the sub-exhaust passage RD does not greatly vary. With this configuration, the hydrocarbon content of the exhaust gas flowing in the main exhaust passage RA does not greatly vary. This improves the efficiency in removing hydrocarbons.

To allow the exhaust gas to flow in the aforementioned mode, the catalytic-converter 3 is configured as described in the following sections (a) and (b). (a) The openings RB2 are positioned so as to allow exhaust gas to flow between the sub-exhaust passage RD and a space where the pressure does not vary greatly (i.e., the pressure is stable) in the absorption portion 5 when the valve 44 is open. More specifically, the openings RB2 are positioned in the manner described in the following (b).

Figure 18:
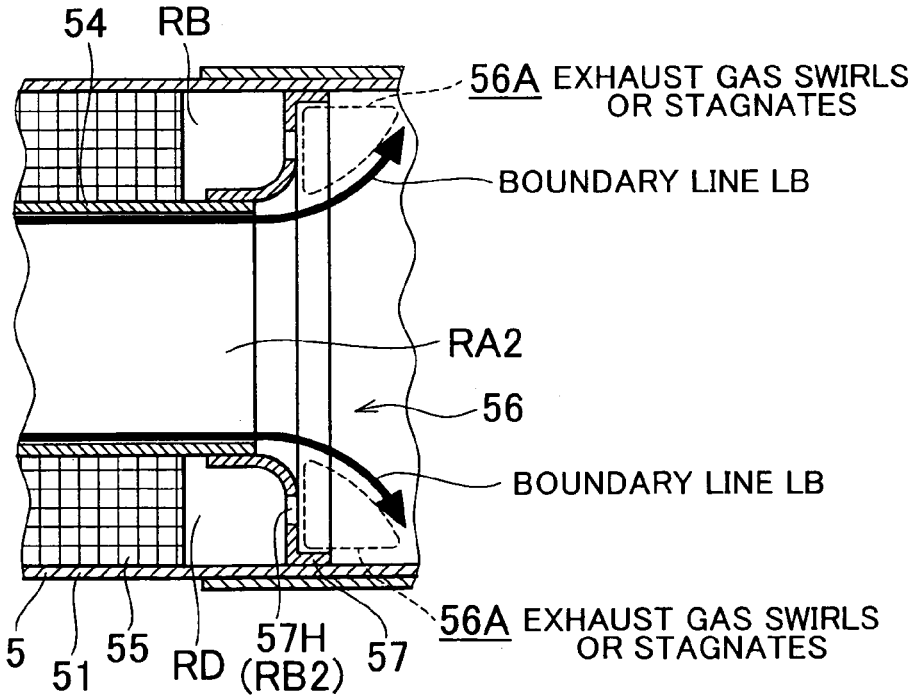
FIG. 18 illustrates the enlarged view of the structure near the partition in the exhaust gas control apparatus for an engine according to the embodiment.

(b) In FIG. 18, a boundary line LB indicates the boundary between a space (i.e., space 56A) where exhaust gas swirls or stagnates and a space where the exhaust gas does not swirl or stagnate. The openings RB2 are positioned distant from the boundary line LB so as to allow exhaust gas to flow between the sub-exhaust passage RD and the space where exhaust gas swirls or stagnates (i.e., the space 56A). That is, the openings RB2 are positioned so as to allow exhaust gas to flow between the sub-exhaust passage RD and the space 56A positioned outside of the boundary line LB (i.e., the space 56A near the external cylinder 51).

The pressure in the space furthest from the boundary line LB is more stable than the pressure in the space near the boundary line LB. Also, the pressure in the space where exhaust gas swirls or stagnates is more stable than that in the space where the exhaust gas does not swirl or stagnate. Therefore, with the aforementioned configuration, the flow speed of the exhaust gas flowing in the sub-exhaust passage RD does not greatly vary.

[3] Next, the flow speed of the exhaust gas flowing in the sub-exhaust passage (when the valve is open) will be described. If the concentration of hydrocarbons in the exhaust gas exceeds an upper limit value at or below which the three-way catalyst 64 can remove all of hydrocarbons present in the exhaust gas when the valve 44 is open, some hydrocarbons will not be removed by the three-way catalyst 64.

Accordingly, the catalytic-converter 3 in this embodiment is configured to reduce the hydrocarbon concentration of the exhaust gas flowing in the main passage RA to a level equal to or less than the upper limit value. That is, the catalytic-converter 3 in this embodiment is configured such that the hydrocarbon concentration in the exhaust gas flowing in the main exhaust passage RA does not exceed the upper limit value. With this configuration, the three-way catalyst 64 can efficiently remove hydrocarbons.

To allow exhaust gas to flow in the aforementioned mode, the catalytic-converter 3 is configured as described in the following section (a). (a) The hydrocarbon concentration in the exhaust gas flowing in the main exhaust passage RA greatly varies depending on the amount of hydrocarbons released from the hydrocarbon-absorbent 55. That is, the hydrocarbon concentration of the exhaust gas flowing in the main exhaust passage RA greatly varies depending on the flow speed of the exhaust gas flowing in the sub-exhaust passage RD. Meanwhile, the flow speed of the exhaust gas flowing in the sub-exhaust passage RD varies depending on the position and the diameter of the inlet port RE.

Accordingly, in this embodiment, the inlet port RE is appropriately positioned and the diameter of the inlet port RE is appropriately set so that the hydrocarbon concentration in the exhaust gas flowing in the main exhaust passage RA is equal to or less than the upper limit value.

The inlet port RE is appropriately positioned by adjusting the distance between the inlet port RE and the valve 44 based on the relation between the distance and the flow speed of the exhaust gas flowing in the sub-exhaust passage RD. Also, the diameter of the inlet port RE is appropriately adjusted by reducing the end portion of the second exhaust pipe 24 in the radial direction based on the relation between the diameter and the flow speed of the exhaust gas flowing in the sub-exhaust passage RD. In some configurations of the catalytic-converter 3, the diameter of the inlet port RE is appropriately set by increasing the end portion of the second exhaust pipe 24 in the radial direction.

[4] Next, the flow speed of the exhaust gas flowing in the sub-exhaust passage when the valve is closed will be described. In the case where the flow speed of the exhaust gas passing through the hydrocarbon-absorbent 55 is excessively high when the valve 44 is closed, the exhaust gas passes through the hydrocarbon-absorbent 55 before the hydrocarbon-absorbent 55 absorbs hydrocarbons. That is, in the case where the flow speed of the exhaust gas is higher than an upper limit speed at or below which the hydrocarbon-absorbent 55 can absorb hydrocarbons, the hydrocarbon-absorbent 55 cannot absorb some hydrocarbons.

Accordingly, the catalytic-converter 3 in this embodiment is configured so that the flow speed of the exhaust gas flowing in the sub-exhaust passage RD does not exceed the upper limit speed when the valve 44 is closed. In this configuration, the hydrocarbon-absorbent 55 can absorb hydrocarbons present in exhaust gas passing through the hydrocarbon-absorbent 55.

To allow exhaust gas to flow in the aforementioned mode, the catalytic- converter 3 is configured as described in the following sections (a) through (d). (a) The relation between the cross sectional area of the opening RC1 and the total of cross sectional areas of the openings RB2 is set so that the flow speed of the exhaust gas flowing in the sub-exhaust passage RD does not exceed the upper limit speed when the valve 44 is closed. More specifically, the cross sectional area of the opening RC1 and the total of the cross sectional areas of the openings RB2 are set in the manner described in the following section (b).

(b) The total of the cross sectional areas of the openings RB2 (i.e., the total of the cross sectional areas of all the partition holes 57H) is less than the cross sectional area of the opening RC1. In addition, the total of the cross sectional areas of the openings RB2 and the cross sectional area of the opening RC1 are set so that exhaust gas flows at the required flow speed.

(c) The opening RC1 and the openings RB2 are positioned so that the difference in pressure between the space upstream of the opening RC1 and the space downstream of the openings RB2 does not become excessively great. That is, the opening RC1 and the openings RB2 are positioned so that the pressure difference does not make the speed of the exhaust gas flowing in the sub-exhaust passage RD higher than the upper limit speed. More specifically, the opening RC1 and the openings RB2 are positioned in the manner described in the following section (d).

(d) The openings RB2 are positioned so as to allow exhaust gas to flow between the sub-exhaust passage RD and the space where exhaust gas swirls or stagnates inside the absorption portion 5. Also, the opening RC1 is positioned so as to allow exhaust gas to flow between the space 45A inside the valve portion 4 and the sub-exhaust passage RD.

The modes where the exhaust gas flows in the catalytic-converter 3 will be described with reference to FIG. 19 and FIG. 20.

An electronic control unit determines whether the three-way catalyst of the catalytic-converter 21 is active in the exhaust system for the engine 1 in this embodiment. If it is determined that the three-way catalyst is not active, the electronic control unit selects a cold-catalyst mode to keep the valve 44 closed. If it is determined that the three-way catalyst is active, the electronic control unit selects a warm-catalyst mode to keep the valve 44 open. The electronic control unit determines whether the three-way catalyst is active based on the operating state of the engine 1.

Figure 19:
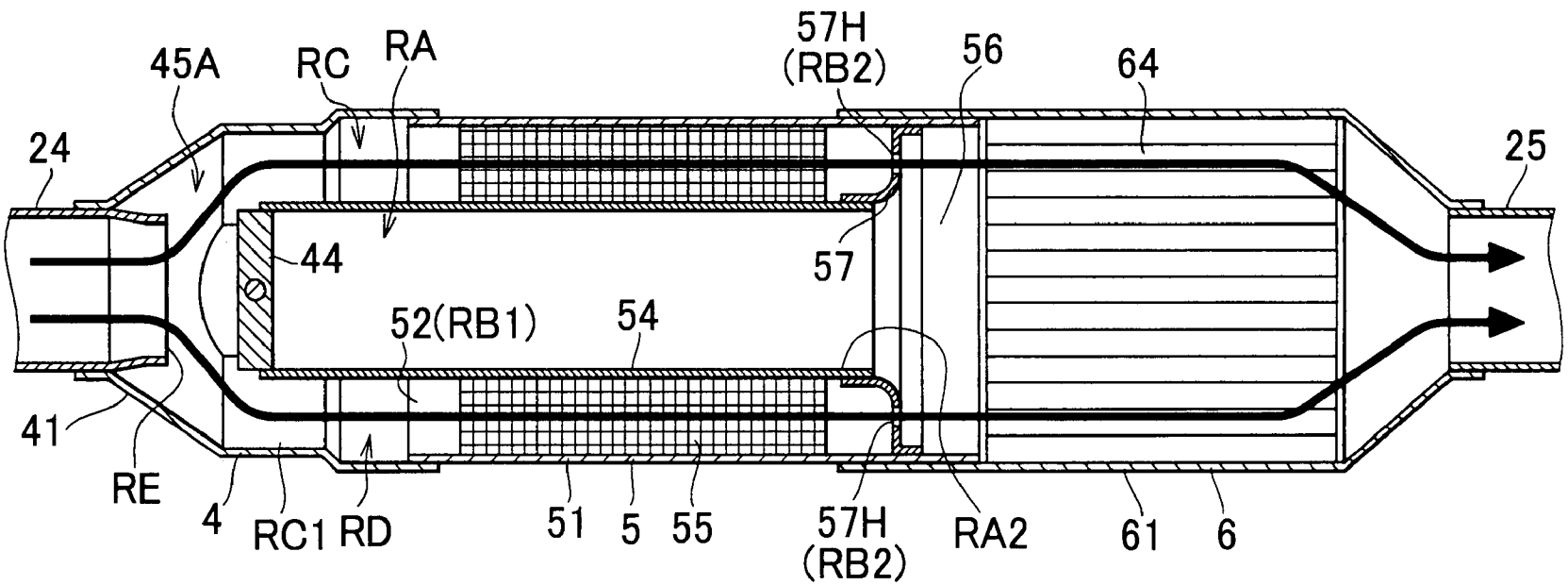
FIG. 19 illustrates the flow of exhaust gas in the exhaust gas control apparatus for an engine according to the embodiment where the valve is closed.

[1] FIG. 19 illustrates the flow of the exhaust gas when the cold-catalyst mode (first mode) is selected. When the cold-catalyst mode is selected, exhaust gas flows in the catalytic-converter 3 as follows.

[a] The exhaust gas in the second exhaust pipe 24 flows into the space 45A inside the valve portion 4 through the opening of the second exhaust pipe 24 (i.e., the inlet port RE).

[b] The exhaust gas in the space 45A inside the valve portion 4 flows into the sub-exhaust passage RD through the opening RC1.

[c] The exhaust gas in the sub-exhaust passage RD passes through the hydrocarbon-absorbent 55, and then flows into the space 56 inside the absorption portion 5 through the openings RB2. The hydrocarbon-absorbent 55 absorbs hydrocarbon present in the exhaust gas when the exhaust gas passes through the hydrocarbon-absorbent 55.

[d] The exhaust gas in the space 56 inside the absorption portion 5 passes through the three-way catalyst 64, and then flows into the third exhaust pipe 25. The three-way catalyst 64 removes nitrogen oxide and carbon monoxide present in the exhaust gas when the exhaust gas passes through the three-way catalyst 64.

Thus, all of the exhaust gas flowing into the catalytic-converter 3 passes through the hydrocarbon-absorbent 55 and then passes through the three-way catalyst 64 when the cold-catalyst mode is selected. This reduces the amount of hydrocarbons released to the atmosphere.

Figure 20:
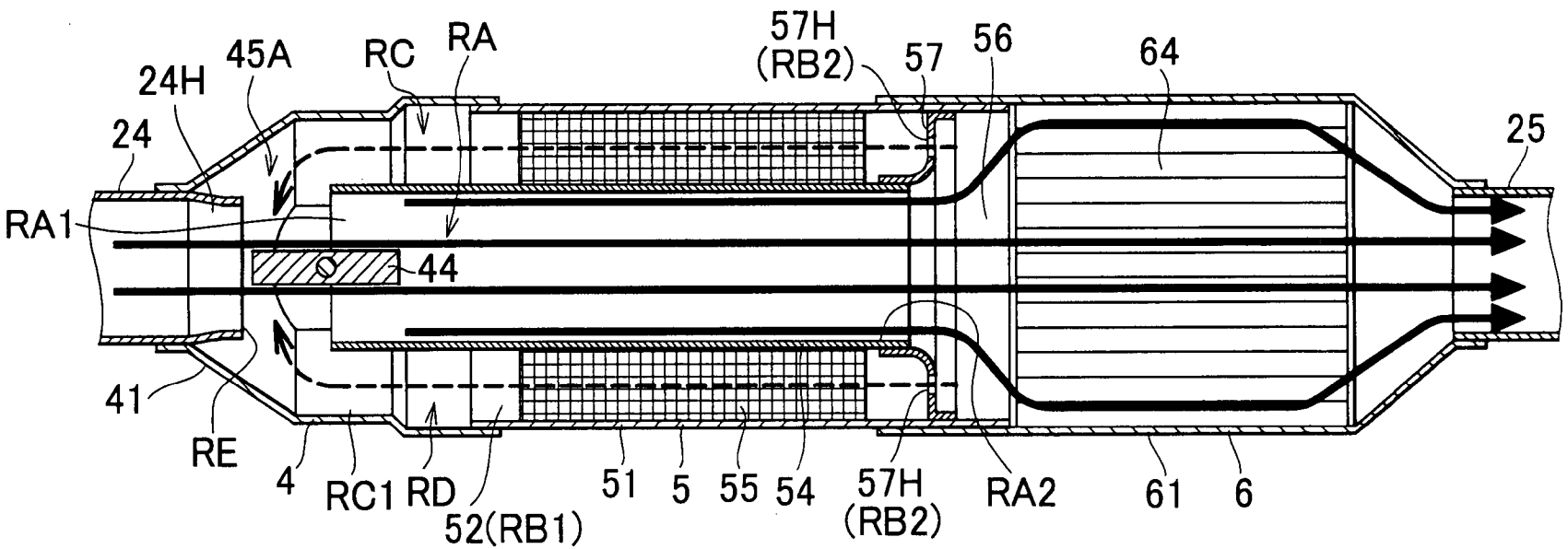
FIG. 20 illustrates the flow of exhaust gas in the exhaust gas control apparatus for an engine according to the embodiment where the valve is open.

[2] FIG. 20 illustrates the flow of the exhaust gas when the warm-catalyst mode (second mode) is selected. When the warm-catalyst mode is selected, the mainstream and sidestream of exhaust gas both flow. Solid lines in FIG. 20 indicate the mainstream. Dashed lines in FIG. 20 indicate the sidestream.

The mainstream of exhaust gas flows as follows.

[a] The exhaust gas in the second exhaust pipe 24 flows into the space 45A inside the valve portion 4 through the opening of the second exhaust pipe 24 (i.e., inlet port RE).

[b] The exhaust gas in the space 45A inside the valve portion 4 flows into the main exhaust passage RA through the valve 44 and the opening RA1.

[c] The exhaust gas in the main exhaust passage RA flows into the space 56 inside the absorption portion 5 through the opening RA2.

[d] The exhaust gas in the space 56 inside the absorption portion 5 passes through the three-way catalyst 64, and then flows into the third exhaust pipe 25. The three-way catalyst 64 removes nitrogen oxide, carbon monoxide, and hydrocarbons present in the exhaust gas when the exhaust gas passes through the three-way catalyst 64.

The sidestream of exhaust gas flows as follows.

[a] The exhaust gas in the space 56 inside the absorption portion 5 flows into the sub-exhaust passage RD through the openings RB2.

[b] The exhaust gas flows in the sub-exhaust passage RD from the downstream side to the upstream side, and passes through the hydrocarbon-absorbent 55. When the exhaust gas passes through the hydrocarbon-absorbent 55, hydrocarbons that have been captured by the hydrocarbon-absorbent 55 are released from the hydrocarbon-absorbent 55, and the hydrocarbons released flow toward the upstream together with the exhaust gas.

[c] The exhaust gas in the upstream of the sub-exhaust passage RD flows into the 45A inside the valve portion 4 through the opening RC1.

[d] The exhaust gas in the space 45A inside the valve portion 4 flows into the mainstream at the space upstream of the valve 44.

Thus, when the warm-catalyst mode is selected, hydrocarbon released from the hydrocarbon-absorbent 55 is carried by the sidestream, and then the hydrocarbons are mixed with the mainstream at the space upstream of the valve 44. When the mainstream passes through the three-way catalyst 64, the three-way catalyst 64 removes the hydrocarbons released.

The exhaust gas control apparatus for an engine according to the invention (i.e., the catalytic-converter 3) has the effects described below.

(1) In the catalytic-converter 3 in this embodiment, the valve portion 4, the absorption portion 5, and the catalyst portion 6 are independent of each other. Also, the valve portion 4, the absorption portion 5, and the catalyst portion 6 are disposed in series. With this configuration, each of the valve portion 4, the absorption portion 5, and the catalyst portion 6 can be replaced with another corresponding portion that achieves the required level of performance, independently of the other portions. For example, the size of the three-way catalyst 64 can be changed without replacing the hydrocarbon-absorbent 55. Thus, with this configuration, any component can be replaced with another corresponding component that achieves the required level of performance while minimizing the number of other components to be replaced.

(2) In the catalytic-converter 3 in this embodiment, when the valve 44 is open, hydrocarbon released from the hydrocarbon-absorbent 55 is sufficiently mixed with the exhaust gas in the mainstream before reaching the three-way catalyst 64. This improves the efficiency of the three-way catalyst 64 in removing hydrocarbons.

(3) In the catalytic-converter 3 in this embodiment, when the valve 44 is open, exhaust gas stably flows in the sub-exhaust passage RD from the downstream side to the upstream side.

(4) In the catalytic-converter 3 in this embodiment, the hydrocarbon concentration in the exhaust gas passing through the three-way catalyst 64 does not greatly vary. This improves the efficiency in removing hydrocarbons.

(5) In the catalytic-converter 3 in this embodiment, the hydrocarbon content of the exhaust gas in the mainstream is equal to or less than the upper limit value at or below which the three-way catalyst 64 can absorb all of hydrocarbon present in the exhaust gas. With this configuration, the three-way catalyst 64 can appropriately remove hydrocarbons.

(6) In the catalytic-converter 3 in this embodiment, the flow speed of the exhaust gas passing through the sub-exhaust passage RD is maintained at a value less than the upper limit speed when the valve 44 is closed. With this configuration, the hydrocarbon-absorbent 55 can sufficiently absorb hydrocarbons.

(7) In the catalytic-converter 3 in this embodiment, the three-way catalyst 64 is provided downstream of the opening RB2 to increase the pressure in the space downstream of the openings RB2. Because the three-way catalyst 64 is used as the resistance, the size of the catalytic-converter 3 does not need to be increased.

(8) In the catalytic-converter 3 in this embodiment, the opening of the second exhaust pipe 24, which functions as the inlet port RE, is opened to the space 45A inside the valve portion 4. That is, the inlet port RE is disposed immediately upstream of the valve 44. By using the opening of the second exhaust pipe 24 as the inlet port RE, another member is not required. This improves productivity.

A production method for the catalytic-converter 3 will be described. The catalytic-converter 3 is produced in steps 1 through 5. [First step] The valve portion 4 that achieves the required level of performance is selected from among different valve portions that achieve different levels of performance. [Second step] The absorption portion 5 that achieves the required level of performance is selected from among different absorption portions that achieve different levels of performance. [Third step] The catalyst portion 6 that achieves the required level of performance is selected from among different catalyst portions that achieve different levels of performance. [Fourth step] The selected valve portion 4, absorption portion 5, and catalyst portion 6 are disposed in series and are joined to each other. [Fifth step] The second exhaust pipe 24 is disposed such that the opening of the second exhaust pipe 24 at the downstream side thereof (i.e., the inlet port RE) is opened to the space 45A inside the valve portion 4. Then, the second exhaust pipe 24 is joined to the valve portion 4.

Producing the exhaust gas control apparatus for an engine in this embodiment according to the described method results in the following effects.

(9) According to the method in this embodiment, different types of catalytic-converters 3 with the absorbent that achieve different levels of performance may be produced by replacing any individual component with another corresponding component that achieves the required level of performance while minimizing the number of other components to be replaced.

The aforementioned embodiment can be appropriately changed as follows.

Figure 21:
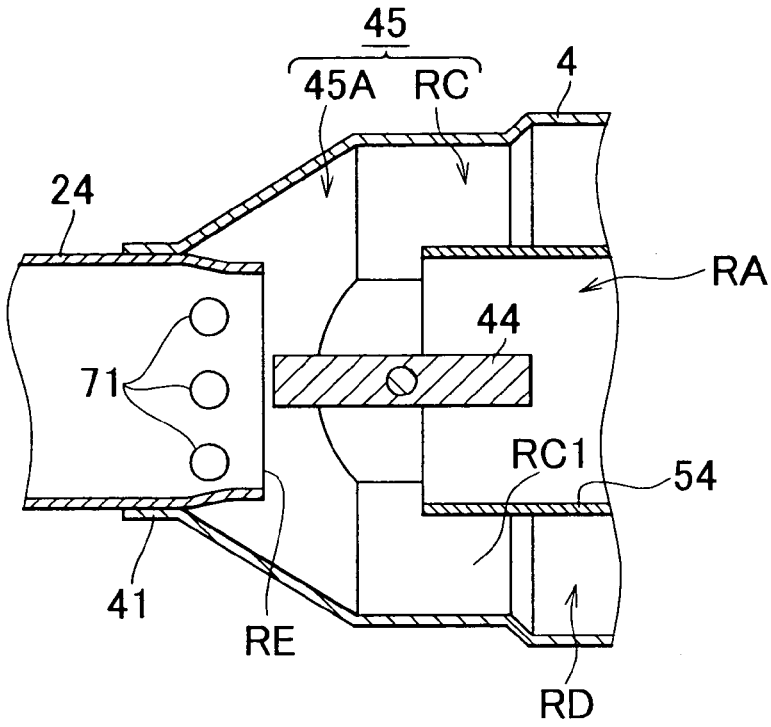
FIG. 21 illustrates the cross sectional view of a catalytic-converter with an absorbent in an exhaust gas control apparatus for an engine according to another embodiment, taken along the axis thereof.

In a first modified example of the aforementioned embodiment, as shown in FIG. 21, the second exhaust pipe 24 includes a plurality of holes 71 which allow exhaust gas to radially flow between the inside and the outside of the second exhaust pipe 24. By forming the holes 71 in the second exhaust pipe 24, the flow speed of the exhaust gas flowing in the sub-exhaust passage RD (i.e., the amount of hydrocarbons released from the hydrocarbon-absorbent 55) can be adjusted. When employing this configuration, the method for producing the catalytic-converter 3 includes a step of forming the holes 71 in the second exhaust pipe 24. This step is performed before the fifth step is performed. With this configuration, the flow speed of the exhaust gas can be adjusted to the required speed without replacing the valve portion 4 or the absorption portion 5. This improves productivity.

In the aforementioned embodiment, by providing the second exhaust pipe 24 in the space 45A inside the valve portion 4, the opening of the second exhaust pipe 24, which functions as the inlet port RE, is disposed immediately upstream of the valve 44. However, for example, the embodiment can be changed as follows. An auxiliary-exhaust pipe that is independent of the second exhaust pipe 24 is connected to an end of the second exhaust pipe 24 at the downstream side thereof, and this auxiliary pipe is disposed in the space 45 inside the valve portion 4. The opening of the auxiliary-exhaust pipe, which is disposed immediately upstream of the valve 44, functions as the inlet port RE.

When employing the aforementioned configuration, by forming holes that allow exhaust gas to radially flow between the inside and the outside of the auxiliary-exhaust pipe, the flow speed of the exhaust gas flowing in the sub-exhaust passage RD can be adjusted. When employing this configuration, the method for producing the catalytic-converter 3 includes a step of forming the holes in the auxiliary-exhaust pipe. This step is performed before the auxiliary-exhaust pipe is disposed in the space 45A inside the valve portion 4.

Figure 22:
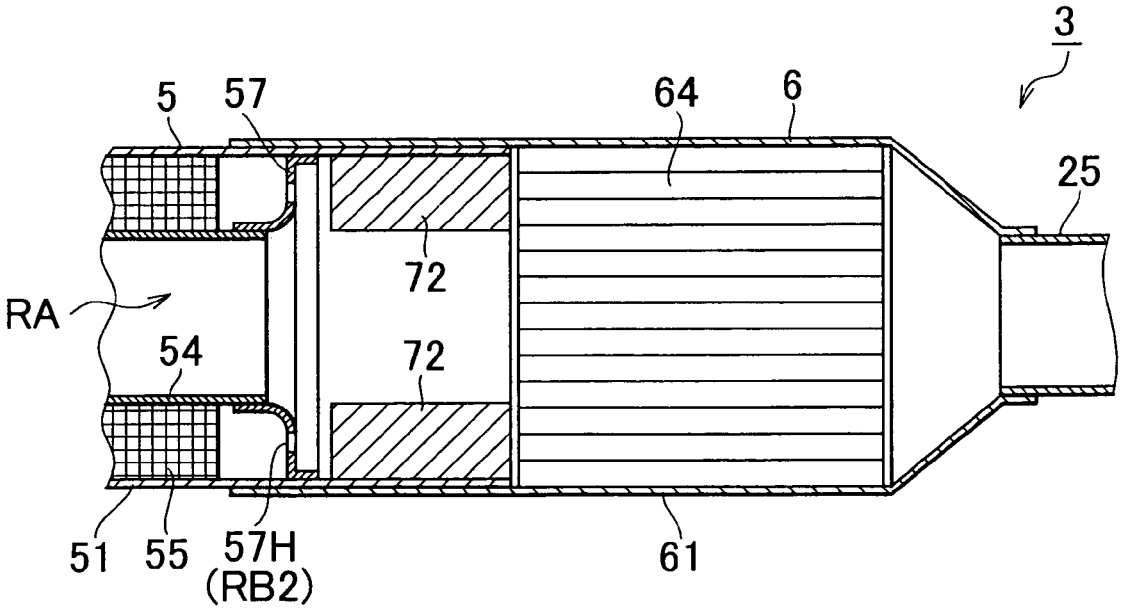
FIG. 22 illustrates the cross sectional view of a catalytic-converter with an absorbent in an exhaust gas control apparatus for an engine according to another embodiment, taken along the axis thereof.

In the aforementioned embodiment, the three-way catalyst 64 is used as the resistance. In a second modified example of the embodiment, as shown in FIG. 22, a sound-absorbing material (glass wool) 72 is disposed downstream of the openings RB2. With this configuration, the sidestream reliably flows in the sub-exhaust passage RD, and the catalytic-converter 3 also functions as a muffler.

Figure 23:
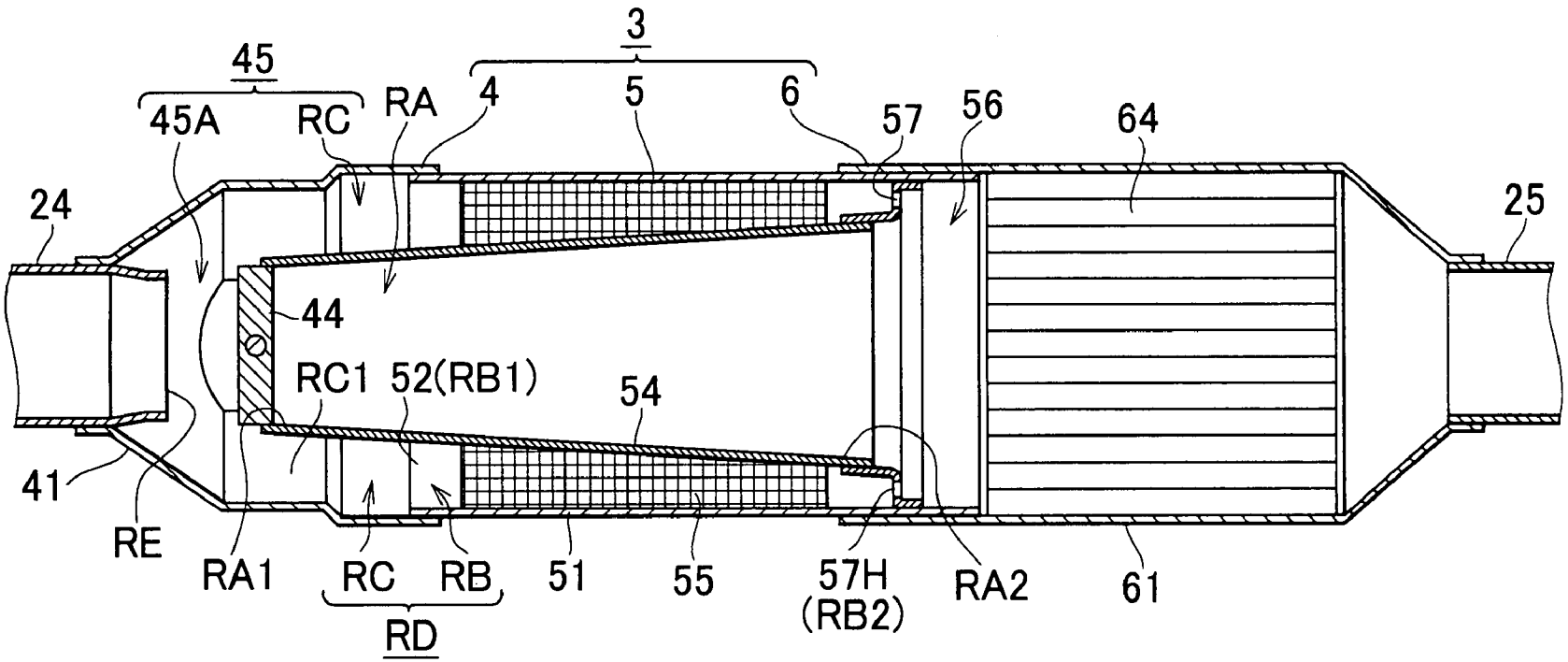
FIG. 23 illustrates the cross sectional view of a catalytic-converter with an absorbent in an exhaust gas control apparatus for an engine according to another embodiment, taken along the axis thereof.

In a third modified example of the embodiment, as shown in FIG. 23, the internal cylinder 54 of the absorption portion 5 has a tapered shape such that the cross sectional area thereof (i.e., the cross sectional area orthogonal to the axis thereof) increases from the upstream side to the downstream side. With this configuration, exhaust gas is less likely to swirl or stagnate. This reduces the backpressure of the engine 1. Also, exhaust gas uniformly flows into the entire area of the three-way catalyst 64. This improves efficiency in purifying exhaust gas.

Figure 24:
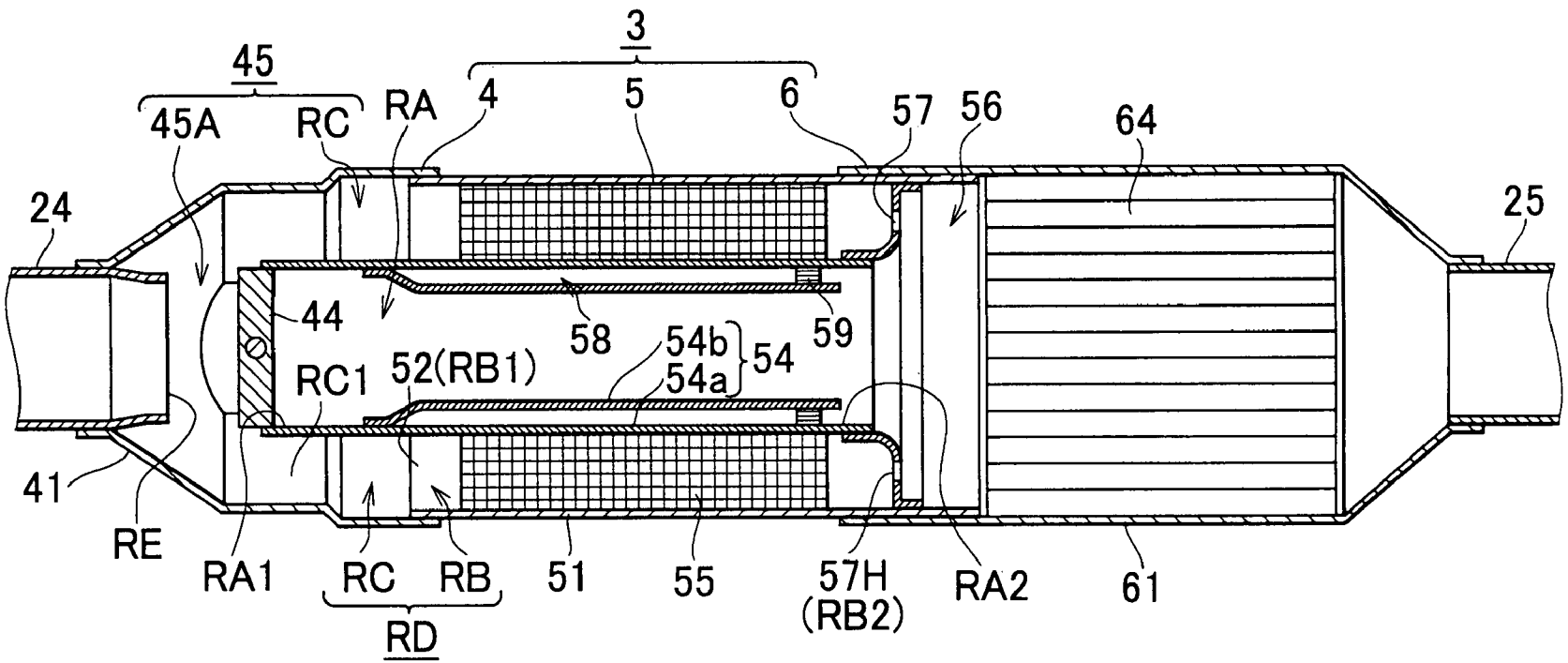
FIG. 24 illustrates the cross sectional view of a catalytic-converter with an absorbent in an exhaust gas control apparatus for an engine according to another embodiment, taken along the axis thereof.

Further, in a fourth modified example of the embodiment, as shown in FIG. 24, the internal cylinder 54 of the absorption portion 5 includes an external pipe 54*a* and an internal pipe 54*b*. The external pipe 54*a* contacts the catalyst portion 6. The internal pipe 54*b* is concentrically disposed within the external pipe 54*a*. A space 58 is formed between the external pipe 54*a* and the internal pipe 54*b*. That is, one end of the internal pipe 54*b* is fixed to the inner surface of the external pipe 54*a* at the upstream side thereof. A wire mesh 59 is provided between the other end of the internal pipe 54*b* and the inner surface of the external pipe 54*a* at the downstream side thereof. The wire mesh 59 offsets the difference in thermal expansion between the external pipe 54*a* and the internal pipe 54*b*. With this configuration, the space 58 serves as a heat-insulating layer. Therefore, when the valve 44 is open, the heat from exhaust gas flowing in the main exhaust passage RA is unlikely to be transmitted to the hydrocarbon-absorbent 55 disposed outside the external pipe 54*a*. This reduces the possibility that the increase in temperature of the hydrocarbon-absorbent 55 will cause all the hydrocarbons captured to be released from the hydrocarbon-absorbent 55 all at once. That is, hydrocarbons captured is gradually released from the hydrocarbon-absorbent 55 by suppressing the increase in the temperature of the hydrocarbon-absorbent 55. This improves efficiency of the catalyst in removing hydrocarbons. The heat-insulating effect may be improved by providing a heat-insulating material in the space 58.

In this case, preferably, the diameter of the portion of the internal pipe 54*b* is gradually reduced going from the upstream side toward the downstream side thereof, as shown in FIG. 24. With this configuration, the high-temperature exhaust gas passing through the internal cylinder 54 of the absorption portion 5 does not directly contact the inner surface of the internal pipe 54*b*. This reduces the amount of heat transmitted to the internal pipe 54*b* from the exhaust gas flowing in the main exhaust passage RA. Thus, by employing this configuration, the heat-insulating effect can be further improved.

While the invention has been described with reference to example embodiments thereof, it is to be understood that the invention is not limited to the example embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. An exhaust gas control apparatus for an engine, comprising:

an absorption portion that includes a first exhaust passage and a second exhaust passage, the respective openings of which are located at different positions, and through which exhaust gas flows into the absorption portion; wherein the first exhaust passage is provided therein with a hydrocarbon-absorbent, which absorbs hydrocarbons present in the exhaust gas;

a valve portion that includes a valve that opens and closes the second exhaust passage, thereby changing a mode where the exhaust gas flows; and a catalyst portion that includes a catalyst that purifies the exhaust gas, wherein the absorption portion, the valve portion, and the catalyst portion are independent of each other; the absorption portion, the valve portion, and the catalyst portion are connected to each other in series, and the first exhaust passage communicates with a space upstream of the second exhaust passage through an upstream-opening positioned upstream of the hydrocarbon-absorbent, and communicates with a space downstream of the second exhaust passage through a downstream-opening positioned downstream of the hydrocarbon-absorbent, when the valve is open, the exhaust gas flows from the valve through the second exhaust passage to the catalyst and a portion of the exhaust gas flows back from the downstream-opening through the first exhaust passage and the upstream-opening to the space upstream of the valve.

2. The exhaust gas control apparatus for an engine, according to claim 1, wherein the valve portion, the absorption portion, and the catalyst portion are disposed from an upstream side to a downstream side.

3. The exhaust gas control apparatus for an engine according to claim 1, wherein, when the valve is closed, the exhaust gas flows from the space upstream of the valve through the upstream-opening, the first exhaust passage and the downstream-opening to catalyst.

4. The exhaust gas control apparatus for an engine according to claim 1, wherein, when the valve is open, the downstream-opening facilitates the flow of the exhaust gas between the first exhaust passage and a space where pressure of the exhaust gas is stable.

5. The exhaust gas control apparatus for an engine according to claim 1, wherein the downstream-opening is positioned at a distance from a boundary between a space where the exhaust gas swirls or stagnates and a space where the exhaust gas does not swirl or stagnate when the valve is open, and the distance is sufficient for the exhaust gas to flow between the first exhaust passage and the space where the exhaust gas does not swirl or stagnate when the valve is open.

6. The exhaust gas control apparatus for an engine according to claim 1, wherein an inlet port, through which the exhaust gas flows into the exhaust gas control apparatus, is positioned such that a straight flow of the exhaust gas from the inlet port does not pass through the upstream-opening.

7. The exhaust gas control apparatus for an engine according to claim 1, wherein the exhaust gas flows into the exhaust gas control apparatus; and the upstream-opening is positioned such that a straight flow of the exhaust gas from the inlet port does not pass through the upstream-opening.

8. The exhaust gas control apparatus for an engine according to claim 1, wherein an inlet port of an exhaust pipe that allows the exhaust gas from the engine to flow therethrough is disposed immediately upstream of the valve, and the exhaust gas flows into the exhaust gas control apparatus through the inlet port.

9. The exhaust gas control apparatus for an engine according to claim 1, wherein an auxiliary-exhaust pipe, which is independent of an exhaust pipe that allows the exhaust gas from the engine to flow therethrough, is connected to a downstream end of the exhaust pipe and disposed immediately upstream of the valve so that a downstream-opening of the auxiliary-exhaust pipe is disposed immediately upstream of the valve to form an inlet port, through which the exhaust gas flows into the exhaust gas control apparatus.

10. The exhaust gas control apparatus for an engine according to claim 9, wherein the auxiliary-exhaust pipe includes a hole which radially communicates between an inside and an outside of the auxiliary-exhaust pipe so as to allow the exhaust gas to flow therethrough.

11. The exhaust gas control apparatus for an engine according to claim 8, wherein a downstream-opening of the exhaust pipe is disposed immediately upstream of the valve to function as the inlet port.

12. The exhaust gas control apparatus for an engine according to claim 11, wherein the exhaust pipe includes a hole, positioned inside the valve portion, which radially communicates between an inside and an outside of the exhaust pipe so as to allow the exhaust gas to flow therethrough.

13. The exhaust gas control apparatus for an engine according to claim 2, wherein the upstream-opening is positioned near the valve, and the downstream-opening is positioned near the catalyst.

14. The exhaust gas control apparatus for an engine according to claim 1, wherein, when the valve is open, the upstream-opening facilitates the flow of the exhaust gas between the first exhaust pipe and a space where the exhaust gas does not swirl or stagnate and the downstream-opening facilitates the flow of exhaust gas between the first exhaust passage and a space where the exhaust gas swirls or stagnates.

15. The exhaust gas control apparatus for an engine according to claim 1, wherein a restrictive element, which reduces a flow speed of the exhaust gas flowing toward the downstream side through the downstream-opening,is provided downstream of the downstream-opening.

16. The exhaust gas control apparatus for an engine according to claim 15, wherein the restrictive element is the catalyst.

17. The exhaust gas control apparatus for an engine according to claim 15, wherein the restrictive element is a sound-absorbing material.

18. The exhaust gas control apparatus for an engine according to claim 1, wherein a relation between a cross sectional area of the upstream-opening and a cross sectional area of the downstream-opening is set so that a flow speed of the exhaust gas flowing in the first exhaust passage is reduced to a speed that is equal to or lower than an upper limit flow speed, at or below which the hydrocarbon-absorbent can absorb all hydrocarbons present in the exhaust gas, when the valve is closed.

19. An exhaust gas control apparatus for an engine, comprising:

an absorption portion that includes an external cylinder, disposed at an outermost position thereof, a first exhaust passage and a second exhaust passage, the respective openings of which are located at different positions, and through which exhaust gas flows into the abosorption portion; and the first exhaust passage is provided with a hydrocarbon-absorbent which absorbs hydrocarbons present in the exhaust gas, and a partition that is provided downstream of the hydrocarbon-absorbent and that separates the first exhaust passage from a first space, the first space being positioned on a downstream side of the absorption portion and on a downstream side of the second exhaust passage, the partition portion being provided with at least one hole through which the exhaust gas flows between the first exhaust passage and the first space;

a valve portion that includes an external cylinder, disposed at an outermost position thereof, and a valve, connected to the external cylinder to face the second exhaust passage, that opens and closes the second exhaust passage, thereby changing a mode where the exhaust gas flows; and a catalyst portion that includes an external cylinder, disposed at an outermost position thereof, and a catalyst that purifies the exhaust gas, wherein the absorption portion, the valve portion, and the catalyst portion are independent of each other; and the absorption portion, the valve portion, and the catalyst portion are connected to each other with the external cylinders.

20. The exhaust gas control apparatus for an engine according to claim 19, wherein the catalyst is disposed so that all of the exhaust gas flowing into a space inside the external cylinder of the catalyst portion passes through the catalyst.

21. The exhaust gas control apparatus for an engine according to claim 19, further comprising:

a heat-insulating portion that suppresses heat transmission from the second exhaust pipe to the hydrocarbon-absorbent.

22. The exhaust gas control apparatus for an engine according to claim 19, wherein the absorption further includes an internal cylinder disposed inside the external cylinder; the first exhaust passage is provided between the external cylinder and the internal cylinder of the absorption portion; and the second exhaust passage is provided inside the internal cylinder.

23. The exhaust gas control apparatus for an engine according to claim 22, wherein the internal cylinder includes a plurality of pipes that are concentrically disposed; and a space is formed between the adjacent pipes.

24. The exhaust gas control apparatus for an engine according to claim 23, wherein the heat-insulating material is disposed in the space between any two adjacent pipes.

25. The exhaust gas control apparatus for an engine according to claim 19, wherein the second exhaust passage has a tapered shape; and a cross sectional area of the second exhaust passage orthogonal to an axis thereof increases from an upstream side toward a downstream side.

26. The exhaust gas control apparatus for an engine according to claim 19, wherein the second exhaust passage allows the exhaust gas to flow therethrough without passing through the hydrocarbon-absorbent.

27. The exhaust gas control apparatus for an engine according to claim 1, wherein the first structure includes an upstream-opening positioned upstream of the hydrocarbon-absorbent, and a downstream-opening positioned downstream of the hydrocaron-absorbent; the upstream-opening allows the exhaust gas to communicate between a space in which the hydrocarbon-absorbent is provided and a space upstream of the upstream-opening and the downstream-opening allows the exhaust gas to communicate between a space in which the hydrocarbon-absorbent is provided and a space downstream of the downstream-opening; and the downstream-opening is positioned so as to stabilize a flow speed of the sidestream.

28. The exhaust gas control apparatus for an engine according to claim 27, wherein, when the second mode is selected, pressure in a space downstream of the downstream-opening is increased so as to be higher than pressure in a space upstream of the upstream-opening.

29. The exhaust gas control apparatus for an engine according to claim 1, wherein the exhaust gas flows through an inlet port into the exhaust gas control apparatus from an exhaust pipe located upstream of the exhaust gas control apparatus; and the inlet port is positioned so that a hydrocarbon concentration in the exhaust gas in the mainstream is equal to or less than an upper limit concentration, at or below which the catalyst can remove all hydrocarbons present in the exhaust gas.

30. The exhaust gas control apparatus for an engine according to claim 1, wherein the exhaust gas flows into the exhaust gas control apparatus through an inlet port; a diameter of the inlet port is set so that a hydrocarbon concentration in the exhaust gas of the mainstream is equal to or less than an upper limit concentration, at or below which the catalyst can remove all hydrocarbons present in the exhaust gas.

31. An exhaust gas control apparatus for an engine, comprising;

a first structure that includes an external cylinder, disposed at an outermost position thereof, a first exhaust passage and a second exhaust passage, the respective openings of which are located at different positions, and through which exhaust gas flows into the first structure; and the first exhaust passage is provided with a hydrocarbon-absorbent, which absorbs hydrocarbons present in exhaust gas discharged from an engine, and a partition that is provided downstream of the hydrocarbon-absorbent and that separates the first exhaust passage from a first space, the first space (1) being positioned on a downstream side of the first structure and on a downstream side of the second exhaust passage and being radially outside an extended cross-section of the second passage, the partition portion being provided with at least one hole through which the exhaust gas flows between the first exhaust passage and the first space, the at least one hole being positioned radially outside of the second passage; and a second structure disposed downstream of the first structure, the second structure including an external cylinder, disposed at an outermost position thereof, and a catalyst, that purifies the exhaust gas discharged from the engine, wherein the first structure and the second structure are independent of each other; and the first structure and the second structure are disposed in series, and are joined to each other, and the first structure and the second structure are connected to each other with the external cylinders.

32. A method for producing an exhaust gas control apparatus for an engine, comprising;

selecting an absorption portion that achieves a required level of performance from among different absorption portions that achieve different levels of performance, wherein each of the absorption portions includes an external cylinder, disposed at an outermost position thereof, a first exhaust passage and a second exhaust passage, the respective openings of which are located at different positions, and through which the exhaust gas flows into the absorption portion; and the first exhaust passage is provided with a hydrocarbon-absorbent that absorbs hydrocarbon present in the exhaust gas, and a partition that is provided downstream of the hydrocarbon-absorbent and that separates the first exhaust passage from a first space, the first space being positioned on a downstream side of the absorption portion and on a downstream side of the second exhaust passage, the partition portion being provided with at least one hole through which the exhaust gas flows between the first exhaust passage and the first space;

selecting a valve portion that achieves a required level of performance from among different valve portions that achieve different levels of performance, wherein each of the valve portions includes an external cylinder, disposed at an outermost position thereof, and a valve, connected to the external cylinder to face the second exhaust passage, that opens and closes the second exhaust passage; and each of the valve portions changes a mode where the exhaust gas flows by opening and closing the second exhaust passage, using the valve;

selecting a catalyst portion that achieves a required level of performance from among different catalyst portions that achieve different levels of performance, wherein each of the catalyst includes an external cylinder, disposed at an outermost position thereof, and a catalyst that purifies the exhaust gas; and disposing, in series, the absorption portion selected in the first step, the valve portion selected in the second step and the catalyst portion selected in the third step, and that are independent of each other, and the absorption portion, the valve portion, and the catalyst portion are connected to each other with the external cylinders.

33. The method for producing the exhaust gas control apparatus for an engine according to claim 32, wherein an auxiliary-exhaust pipe, which is independent of an exhaust pipe positioned upstream of the exhaust gas control apparatus, is connected to an end at a downstream side of the exhaust pipe; the auxiliary-exhaust pipe includes an opening positioned at a downstream side thereof; and the opening of the auxiliary-exhaust pipe is disposed immediately upstream of the valve.

34. The method for producing the exhaust gas control apparatus for an engine according to claim 33, wherein a hole, which allows the exhaust gas to radially flow between an inside and an outside of the auxiliary-exhaust pipe, is formed in the auxiliary-exhaust pipe before the auxiliary-exhaust pipe is connected to the exhaust pipe.

35. The method for producing the exhaust gas control apparatus for an engine according to claim 34, wherein the exhaust pipe includes an opening positioned at a downstream side thereof, and the opening of the exhaust pipe is disposed immediately upstream of the valve.

36. The method for producing the exhaust gas control apparatus for an engine according to claim 35, wherein a hole, which allows the exhaust gas to radially flow between an inside and an outside of the exhaust pipe, is formed in a portion of the exhaust pipe located inside the valve portion, before the exhaust pipe is disposed immediately upstream the valve portion.

* * * * *